US009719211B2

(12) United States Patent
Ikenaga

(10) Patent No.: US 9,719,211 B2
(45) Date of Patent: Aug. 1, 2017

(54) METHOD OF PRODUCING STRUCTURE FOR PRODUCING CASTING, AND STRUCTURE SUCH AS MOLD

(71) Applicant: KAO CORPORATION, Tokyo (JP)

(72) Inventor: Haruki Ikenaga, Toyohashi (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 14/758,131

(22) PCT Filed: Dec. 25, 2013

(86) PCT No.: PCT/JP2013/084549
§ 371 (c)(1),
(2) Date: Jun. 26, 2015

(87) PCT Pub. No.: WO2014/104045
PCT Pub. Date: Jul. 3, 2014

(65) Prior Publication Data

US 2015/0361619 A1 Dec. 17, 2015

(30) Foreign Application Priority Data

Dec. 28, 2012 (JP) ..... 2012-286567

(51) Int. Cl.

| | |
|---|---|
| ***D21H 21/18*** | (2006.01) |
| ***B22C 9/02*** | (2006.01) |
| ***B22C 1/00*** | (2006.01) |
| ***B22C 9/08*** | (2006.01) |
| ***D21H 11/14*** | (2006.01) |
| ***D21H 13/50*** | (2006.01) |
| ***D21H 17/48*** | (2006.01) |
| ***D21H 13/36*** | (2006.01) |
| ***D21H 15/02*** | (2006.01) |
| ***D21H 15/08*** | (2006.01) |
| ***D21H 17/46*** | (2006.01) |
| ***D21H 17/52*** | (2006.01) |
| ***D21H 17/63*** | (2006.01) |
| ***D21H 17/00*** | (2006.01) |
| ***D21H 21/52*** | (2006.01) |

(52) U.S. Cl.
CPC ..... *D21H 21/18* (2013.01); *B22C 1/00* (2013.01); *B22C 9/02* (2013.01); *B22C 9/082* (2013.01); *D21H 11/14* (2013.01); *D21H 13/36* (2013.01); *D21H 13/50* (2013.01); *D21H 15/02* (2013.01); *D21H 15/08* (2013.01); *D21H 17/46* (2013.01); *D21H 17/48* (2013.01); *D21H 17/52* (2013.01); *D21H 17/63* (2013.01); *D21H 17/74* (2013.01); *D21H 21/52* (2013.01)

(58) Field of Classification Search
CPC ..... B22C 1/00–1/26; B22C 9/00–9/30; D21H 21/18; D21H 13/50; D21H 11/14; D21H 17/48
USPC ..... 162/147
See application file for complete search history.

(56) References Cited

U.S. PATENT DOCUMENTS

| | | | |
|---|---|---|---|
| 2004/0069429 | A1 | 4/2004 | Tsuura et al. |
| 2005/0199366 | A1 | 9/2005 | Vandermeer et al. |
| 2005/0252632 | A1 | 11/2005 | Vandermeer et al. |
| 2006/0130987 | A1 | 6/2006 | Tsuura et al. |
| 2008/0105401 | A1 | 5/2008 | Nakai et al. |
| 2009/0211717 | A1 | 8/2009 | Takagi et al. |
| 2010/0307714 | A1 | 12/2010 | Yoshida et al. |

FOREIGN PATENT DOCUMENTS

| | | | |
|---|---|---|---|
| CN | 1041715 | A | 5/1990 |
| CN | 1671492 | A | 9/2005 |
| CN | 1711143 | A | 12/2005 |
| CN | 1942262 | A | 4/2007 |
| CN | 102527937 | A | 5/2008 |
| CN | 101213036 | A | 7/2008 |
| CN | 101316665 | A | 12/2008 |
| CN | 101925424 | A | 12/2010 |
| CN | 102527937 | A | 7/2012 |
| JP | 53-43034 | A | 4/1978 |
| JP | 53-48026 | A | 5/1978 |
| JP | 2002-292450 | A | 10/2002 |
| JP | 2004-174605 | A | 6/2004 |
| JP | 2004-181472 | A | 7/2004 |

(Continued)

OTHER PUBLICATIONS

English machine translation of JP-2002-292450-A, published Oct. 8, 2002.
English machine translation of JP-2007-191823-A, published Aug. 2, 2007.
English machine translation of JP-2007-21578-A, published Feb. 1, 2007.
English machine translation of JP-53-43034-A, published Apr. 18, 1978.
English machine translation of JP-53-48026-A, published May 1, 1978.

(Continued)

*Primary Examiner* — Mark Halpern
(74) *Attorney, Agent, or Firm* — Birch, Stewart, Kolasch & Birch, LLP

(57) ABSTRACT

Provided is a method of producing a structure for producing a casting, including: a process (I) of obtaining a slurry composition containing an organic fiber, an inorganic fiber, a thermosetting resin, and water; a process (II) of obtaining a fiber laminate by subjecting the slurry composition to papermaking; and a process (III) of dehydrating the fiber laminate and thereafter drying the resultant, in which the process (I) includes a process (I-1) of beating a mixture containing the organic fiber and water, a process (I-2) of mixing the mixture obtained in the process (I-1) and water, and a process (I-3) of mixing the mixture obtained in the process (I-2) and the inorganic fiber, the thermosetting resin is mixed in at least any of the process (I-1), the process (I-2), and the process (I-3), and an average fiber length of the inorganic fiber in the structure for producing a casting is 1 mm or longer and 5 mm or shorter.

13 Claims, 2 Drawing Sheets

(56) References Cited

FOREIGN PATENT DOCUMENTS

| | | | |
|---|---|---|---|
| JP | 2005-349428 | A | 12/2005 |
| JP | 2007-21578 | A | 2/2007 |
| JP | 2007-191823 | A | 8/2007 |
| JP | 2009-195991 | A | 9/2009 |

OTHER PUBLICATIONS

International Preliminary Report on Patentability and English translation of the Written Opinion of the International Searching Authority (forms PCT/IB/373 and PCT/ISA/237), issued Jun. 30, 2015, for International Application No. PCT/JP2013/084549.

International Search Report, issued in PCT/JP2013/084549, dated Mar. 11, 2014.

Chinese Office Action and Chinese Search Report, issued Apr. 5, 2016, for Chinese Application No. 201380068097.3, along with a partial English translation of the Chinese Office Action.

Chinese Office Action and Search Report, dated Nov. 15, 2016, for Chinese Application No. 201380068097.3, including a partial English Translation.

Chinese Office Action and Search Report issued in Chinese Application No. 201380068097.3 on Apr. 13, 2017, together with an English translation of the Chinese Office Action.

METHOD OF PRODUCING STRUCTURE FOR PRODUCING CASTING, AND STRUCTURE SUCH AS MOLD

This application is a 371 of PCT/JP2013/084549 filed 25 Dec. 2013.

FIELD OF THE INVENTION

The present invention relates to a method of producing a structure such as a mold which is used to produce a casting, a method of producing a casting, and a structure such as a mold.

BACKGROUND OF THE INVENTION

In general, a casting is produced by forming a mold having a cavity therein using molding sand on the basis of a wooden mold or a metallic mold, disposing a core in the cavity as necessary, and thereafter supplying molten metal into the cavity.

To produce the wooden mold or the metallic mold, skill in the processing thereof is required, and an expensive facility is needed. Therefore, disadvantages such as high cost and heavy weight and problems in waste disposal occur, and thus it is difficult to use the molds for uses other than mass-produced castings. In addition, the shape of a sand mold, which uses molding sand, is retained by adding a binder to typical sand and hardening. Therefore, a regeneration treatment process is essential for reusing the sand. In addition, there is also a problem of the generation of waste such as dust during the regeneration treatment. Moreover, in a case of producing a core using the sand mold, in addition to the above problems, it is difficult to handle the core due to the mass of the core itself. In addition, conflicting characteristics such as a strength holding characteristic during casting and a core removing characteristic after casting are required.

As a technique to solve the problems, known are structures formed of members used in molds, such as an organic fiber, an inorganic fiber, and a thermosetting resin as primary components.

For example, in JP-A 2004-181472, a structure for producing a casting is disclosed which contains an organic fiber, an inorganic fiber, and a thermosetting resin such that the structure for producing a casting has good moldability and a light weight, and has sufficient hot strength and shape retention during casting, allows the obtained casting to have excellent shape retention and surface smoothness, and has excellent removability after casting.

In JP-A 2005-349428, a structure for producing a casting is disclosed which contains an organic fiber, a carbon fiber, inorganic particles, and at least one type of thermosetting resin selected from a phenolic resin, an epoxy resin, and a furan resin such that the structure for producing a casting has good moldability, has sufficient hot strength and shape retention during casting even when the weight thereof is light, allows the obtained casting to have excellent shape retention and surface smoothness, and has excellent removability after casting.

In JP-A 2007-21578, a structure for producing a casting is disclosed which is configured to include a structure (I) containing an organic fiber, an inorganic fiber, and a binder, and inorganic particles which have an average particle diameter of 1 nm to 800 nm and adhere to the surface of the structure (I) such that gas defects as casting quality can be improved.

SUMMARY OF THE INVENTION

According to the invention, there is provided a method of producing a structure for producing a casting, the method including:

- a process (I) of obtaining a slurry composition containing an organic fiber, an inorganic fiber, a thermosetting resin, and water;
- a process (II) of obtaining a fiber laminate by subjecting the slurry composition to papermaking; and
- a process (III) of dehydrating the fiber laminate and thereafter drying the resultant, in which the process (I) includes:

- a process (I-1) of beating a mixture containing the organic fiber and water,
- a process (I-2) of mixing the mixture obtained in the process (I-1) and water, and
- a process (I-3) of mixing the mixture obtained in the process (I-2) and the inorganic fiber, the thermosetting resin is mixed in at least any of the process (I-1), the process (I-2), and the process (I-3), and an average fiber length of the inorganic fiber in the structure for producing a casting is 1 mm or longer and 5 mm or shorter.

In addition, according to the invention, there is provided a method of producing a structure for producing a casting, the method including:

- a process (I) of obtaining a slurry composition containing an organic fiber, an inorganic fiber, inorganic particles, a thermosetting resin, and water;
- a process (II) of obtaining a fiber laminate by subjecting the slurry composition to papermaking; and
- a process (III) of dehydrating the fiber laminate and thereafter drying the resultant, in which the process (I) includes:

- a process (I-1) of beating a mixture containing the organic fiber and water,
- a process (I-2) of mixing the mixture obtained in the process (I-1) and water, and
- a process (I-3) of mixing the mixture obtained in the process (I-2) and the inorganic fiber, the thermosetting resin is mixed in at least any of the process (I-1), the process (I-2), and the process (I-3), the inorganic particles are mixed in at least any of the process (I-1), the process (I-2), and the process (I-3), and an average fiber length of the inorganic fiber in the structure for producing a casting is 1 mm or longer and 5 mm or shorter.

In addition, according to the invention, there is provided a method of producing a casting, which uses the structure for producing a casting obtained in the producing method.

In addition, according to the invention, there is provided a structure for producing a casting obtained from a slurry composition containing: an organic fiber; an inorganic fiber; a thermosetting resin; and water, in which an average fiber length of the inorganic fiber in the structure for producing a casting is 1 mm or longer and 5 mm or shorter.

In addition, according to the invention, there is provided a structure for producing a casting obtained from a slurry composition containing: an organic fiber; an inorganic fiber; inorganic particles; a thermosetting resin; and water, in which an average fiber length of the inorganic fiber in the structure for producing a casting is 1 mm or longer and 5 mm or shorter.

DETAILED DESCRIPTION OF THE INVENTION

During casting using a structure for producing a casting, sufficient surface smoothness and strength of the structure for producing a casting, a low thermal contraction amount of the structure for producing a casting, low resistance of metal penetration of the obtained casting, and the like are required. Particularly, during casting under a high pressure or during casting with a large casting mass, it is desirable to enhance such characteristics.

The invention provides a structure for producing a casting, which has excellent surface smoothness and strength, has a low thermal contraction amount, and allows the obtained casting to have excellent resistance of metal penetration.

According to a method of producing the structure for producing a casting of the invention, the structure for producing a casting having excellent surface smoothness and strength has a low thermal contraction amount, and allows the obtained casting to have excellent resistance of metal penetration is provided. The structure for producing a casting produced in the invention is appropriate for casting under a high pressure or for casting with a large casting mass.

Figure 1:
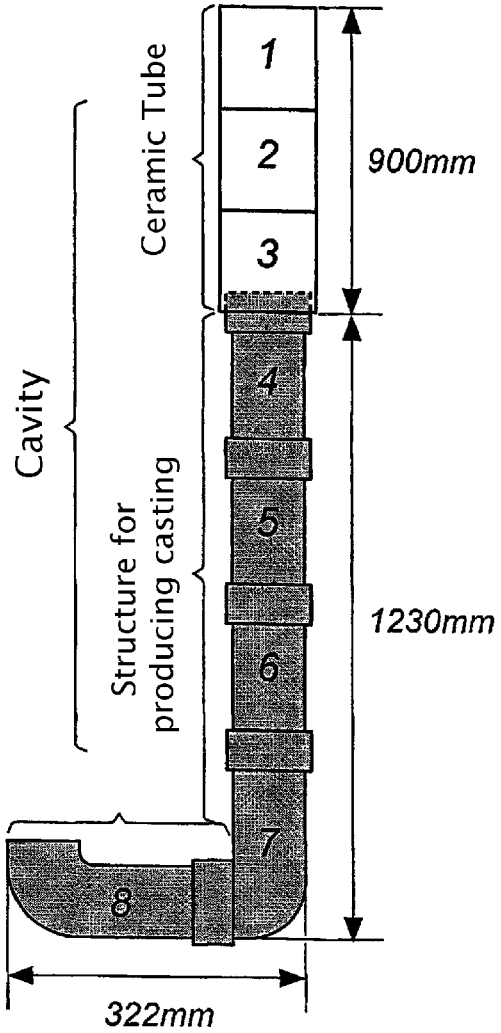
FIG. 1 is a schematic view illustrating a cavity formed by a ceramic tube and a structure for producing a casting used in Examples and Comparative Examples.

According to the invention, there is provided a method of producing a structure for producing a casting, the method including: a process (I) of obtaining a slurry composition (hereinafter, sometimes referred to as a raw material slurry) containing an organic fiber, an inorganic fiber, a thermosetting resin, water, and furthermore inorganic particles according to cases; a process (II) of obtaining a fiber laminate by subjecting the slurry composition to papermaking; and a process (III) of dehydrating the fiber laminate and thereafter drying the resultant, in which the process (I) includes a process (I-1) of beating a mixture containing the organic fiber, the thermosetting resin according to cases, and water, a process (I-2) of mixing the mixture obtained in the process (I-1), the thermosetting resin according to cases, and water, and a process (I-3) of mixing the mixture obtained in the process (I-2), the inorganic fiber, and the thermosetting resin according to cases. The inorganic particles are mixed in at least any of the process (I-1), the process (I-2), and the process (I-3) according to cases, and an average fiber length of the inorganic fiber in the structure for producing a casting is 1 mm or longer and 5 mm or shorter. The present invention has advantages in that the structure for producing a casting has excellent surface smoothness and strength, has a low thermal contraction amount, and allows the obtained casting to have excellent resistance of metal penetration.

Hitherto, a structure for producing a casting obtained from a slurry composition containing an organic fiber, an inorganic fiber, a thermosetting resin, and water or a slurry composition containing an organic fiber, an inorganic fiber, inorganic particles, a thermosetting resin, and water is known. However, the inorganic fiber is cut during a beating treatment, and thus the average fiber length of the inorganic fiber is changed.

On the other hand, the reason why the above advantages are exhibited in the invention is not clear, but is thought as follows.

In the producing method of the invention, as the process (I), the process (I-1) of beating a mixture containing the organic fiber, the thermosetting resin according to cases, and water, the process (I-2) of mixing the mixture obtained in the process (I-1), the thermosetting resin according to cases, and water, and the process (I-3) of mixing the mixture obtained in the process (I-2), the inorganic fiber, and the thermosetting resin according to cases are performed. In addition, the inorganic particles are mixed in at least any of the process (I-1), the process (I-2), and the process (I-3) according to cases. That is, in the beating process, the inorganic fiber is not contained in the mixture. The inorganic fiber is not cut and can be used while the inorganic fiber has its original fiber length, and thus the strength of the structure for producing a casting is enhanced. Therefore, even during casting with a point to which a high pressure is applied during casting or during casting with a large casting mass, excellent resistance of metal penetration can be exhibited.

In addition, thermal contraction of the structure for producing a casting is caused by carbonization shrinkage of the thermosetting resin in the structure for producing a casting due to heat during casting. As the fiber length of the inorganic fiber (for example, carbon fiber) in the structure for producing a casting is increased, the movement of the thermosetting resin is impeded, and thus thermal contraction can be prevented. As described above, it is presumed that the shape of the structure is maintained by suppressing thermal contraction, and as a result, the strength of the structure is further increased, thereby providing excellent resistance of metal penetration in the obtained casting.

In addition, in the producing method of the invention, after adding water in the process (I-2), the inorganic fiber is added in the process (I-3). Therefore, the concentration of the inorganic fiber in the slurry is reduced during the addition of the inorganic fiber, and thus lumps of the inorganic fiber are not generated. Therefore, it is thought that the molded structure for producing a casting has excellent surface smoothness.

In addition, when the average fiber length of the inorganic fiber is greater than 5 mm, the freeness of the slurry is increased. Therefore, the thickness of a connection site of a metallic mold which is a site having high freeness during papermaking, that is, a part without a mesh is reduced, and thus strength is reduced. As a result, it is thought that the strengths of the connection site and the other sites become uneven, and thus metal penetration is likely to occur from the connection site with low strength.

Hereinafter, the invention will be described on the basis of preferred embodiments.

<Structure for Producing Casting>

The structure for producing a casting produced in the invention contains the organic fiber, the inorganic fiber, and the thermosetting resin, and contains the inorganic particles according to cases. Hereinafter, the organic fiber, the inorganic fiber, and the thermosetting resin, and the inorganic particles used according to cases will be described. However, the following description can also be applied to the organic fiber, the inorganic fiber, the inorganic particles, and the thermosetting resin used in the processes (I), (II), and (III).

(i) Organic Fiber

The organic fiber forms its skeleton in a state before the structure for producing a casting is used for casting, and a portion or the entirety thereof is burnt by heat of molten metal during the casting, thereby forming cavities in the structure for producing a casting after producing the casting.

As the organic fiber, from the viewpoint of moldability, a paper fiber, a fibrillated synthetic fiber, a regenerated fiber (for example, rayon fiber), or the like is preferable, and they are used singly or in a combination of two or more kinds thereof. Among the fibers, from the viewpoint of enhancing the moldability of the structure for producing a casting, from the viewpoint of excellent green strength in the dehydrated and dried molded body, and from the viewpoint of availability, supply stability, and economic efficiency of the paper fiber, the paper fiber is preferable. As the paper fiber, wood pulp or non-wood pulp such as cotton pulp, linter pulp, bamboo, and straw may be used. In addition, as the paper fiber, virgin pulp and waste paper pulp (recovered product) may be used singly or in a combination of two or more kinds thereof. As the organic fiber, from the viewpoint of enhancing the moldability of the structure for producing a casting, supply stability, economic efficiency, and environmental protection, it is more preferable that waste paper pulp (newspaper or the like) be used.

The average fiber length of the organic fiber is preferably 0.8 mm or longer and more preferably 0.9 mm or longer from the viewpoint of enhancing the strength of the structure for producing a casting, and is preferably 2 mm or shorter, more preferably 1.8 mm or shorter, and even more preferably 1.5 mm or shorter from the viewpoint of enhancing the surface smoothness of the structure for producing a casting.

The content of the organic fiber in the structure for producing a casting is preferably 1 part by mass or more, more preferably 5 parts by mass or more, even more preferably 10 parts by mass or more, and even more preferably 20 parts by mass with respect to 100 parts by mass of the structure for producing a casting from the viewpoint of enhancing the moldability of the structure for producing a casting, and is preferably 40 parts by mass or less and more preferably 30 parts by mass or less with respect to 100 parts by mass of the structure for producing a casting from the viewpoint of suppressing a gas generation amount during casting.

(ii) Inorganic Fiber

The inorganic fiber primarily forms its skeleton in a state before the structure for producing a casting is used for casting, and is not burnt by heat of molten metal during the casting such that the shape thereof is maintained. Particularly, in a case where the thermosetting resin, which will be described later, is used, the inorganic fiber can suppress thermal contraction caused by the pyrolysis of the thermosetting resin due to heat of the molten metal.

As the inorganic fiber, a carbon fiber, an artificial mineral fiber such as rock wool, a ceramic fiber, a natural mineral fiber, a glass fiber, a silica fiber, or a metallic fiber may be used. One kind or two or more kinds of the inorganic fibers may be used. Among the inorganic fibers, from the viewpoint of suppressing thermal contraction during casting, a carbon fiber having high strength at a high temperature at which metal is melted is preferable. Among the carbon fibers, a pitch-based or polyacrylonitrile (PAN)-based carbon fiber is preferably used, and the PAN-based carbon fiber is more preferable.

The average fiber length of the inorganic fiber, preferably the carbon fiber in the structure for producing a casting is 1 mm or longer and preferably 2 mm or longer from the viewpoint of enhancing the strength of the structure for producing a casting and suppressing thermal contraction and from the viewpoint of preventing metal penetration of the casting, and is 5 mm or shorter and more preferably 4 mm or shorter from the viewpoint of enhancing the strength of the structure for producing a casting and from the viewpoint of preventing metal penetration of the casting. Here, the average fiber length of the inorganic fiber in the structure for producing a casting can be obtained by observing the fiber lengths of the inorganic fibers that are present on the surface of the structure for producing a casting, measuring the fiber lengths of 50 fibers per 1 $cm^2$, and calculating the average value thereof. Measurement of the fiber lengths can be performed using an enlarging means such as a microscope. In Examples, the average fiber length of the inorganic fiber in the structure is measured in this method.

The content of the inorganic fiber, preferably the carbon fiber in the structure for producing a casting is, with respect to 100 parts by mass of the structure for producing a casting, preferably 1 part by mass or more, more preferably 2 parts by mass or more, and even more preferably 3 parts by mass or more from the viewpoint of enhancing the strength of the structure for producing a casting, suppressing thermal contraction, and enhancing resistance of metal penetration, and is preferably 6 parts by mass or less, more preferably 5 parts by mass or less, and even more preferably 4 parts by mass or less from the viewpoint of suppressing the generation of lumps during the slurry preparation in the process (I) and enhancing the surface smoothness of the structure for producing a casting.

The mass ratio of the organic fiber to the inorganic fiber, preferably the mass ratio of the organic fiber to the carbon fiber is, in terms of inorganic fiber/organic fiber, furthermore, carbon fiber/organic fiber, preferably 0.05 or higher, more preferably 0.1 or higher, even more preferably 0.12 or higher, and even more preferably 0.15 or higher from the viewpoint of enhancing the strength of the structure for producing a casting, suppressing thermal contraction, and enhancing resistance of metal penetration, and is preferably 1.0 or lower and more preferably 0.5 or lower from the viewpoint of preventing the generation of lumps in the structure for producing a casting, enhancing surface smoothness, and enhancing moldability and strength.

In addition, the ratio of the major axis to the minor axis of the inorganic fiber, preferably the carbon fiber in the structure for producing a casting is preferably 1 or higher, more preferably 10 or higher, and even more preferably 50 or higher, and is preferably 5000 or lower, more preferably 2000 or lower, and even more preferably 1000 or lower from the viewpoint of enhancing the strength of the structure for producing a casting, from the viewpoint of enhancing the moldability of the structure for producing a casting, and from the viewpoint of suppressing the thermal contraction of the structure for producing a casting.

(iii) Inorganic Particles

By mixing the inorganic particles with the structure for producing a casting according to cases, hot strength is exhibited.

As the inorganic particles, from the viewpoint of fire resistance, aggregate particles of a refractory material such as obsidian, graphite, mica, silica, hollow ceramic, and fly ash are preferable. Among the inorganic particles, obsidian is more preferable. They may be used singly or in a combination of two or more selected therefrom as the inorganic particles. In addition, hollow ceramic is referred to as hollow particles contained in fly ash and can be obtained through flotation of fly ash using water.

The average particle diameter of the inorganic particles is preferably 10 μm or longer and more preferably 20 μm or longer from the viewpoint of enhancing the moldability of the structure for producing a casting, and is preferably 60 μm or shorter and more preferably 40 μm or shorter from the same viewpoint.

Regarding the average particle diameter of the inorganic particles, in a case where the average particle diameter obtained in a first measurement method described below is 200 μm or longer, the value is determined as the average particle diameter. In a case where the average particle diameter obtained in the first measurement method is shorter than 200 μm, the average particle diameter can be obtained through measurement using a second measurement method described below.

[First Method of Measurement]

Particle diameters are measured in accordance with a method defined in JIS Z2601 (1993) "Method for determining foundry molding sand properties" Annex 2. A diameter at which an accumulated volume of particles accounts for 50% of the total volume is considered as an average particle diameter. The "accumulated volume" is calculated based on the presumption that particles remaining on a sieve have an "average diameter Dn (mm)" shown in JIS Z2601 (1993), explanatory Table 2.

[Second Measurement Method]

The average particle diameter is measured with a cumulative volume of 50% by using a laser diffraction particle size distribution analyzer (LA-920 manufactured by Horiba, Ltd.). Analytic conditions are as follow:

Measurement method: flow method

Refractive index: varying according to various types of inorganic particles (refer to the manual attached to LA-920)

Dispersion medium: appropriately selected according to various types of inorganic particles Dispersion method: stirring for three minutes at embedded ultrasonic frequency (22.5 kHz)

Sample concentration: 2 mg/100 $cm^3$

The content of the inorganic particles in the structure for producing a casting is, with respect to 100 parts by mass of the structure for producing a casting, preferably 10 parts by mass or more, more preferably 20 parts by mass or more, and even more preferably 40 parts by mass or more from the viewpoint of enhancing hot strength during the casting of the structure for producing a casting, and is preferably 80 parts by mass or less, more preferably 70 parts by mass or less, and even more preferably 60 parts by mass or less from the viewpoint of enhancing the strength of the structure for producing a casting.

(iv) Thermosetting Resin

As the thermosetting resin, phenolic resins, epoxy resins, furan resins, or the like are preferable. Among these resins, preferred are phenol resins, because phenol resins produce a small amount of flammable gas, have combustion-suppressing effects, and have high residual carbon ratio after pyrolysis (carbonization).

As the phenolic resin, a novolac phenolic resin, a resol type phenolic resin, a urea-, melamine-, or epoxy-modified phenolic resin, or the like may be employed. Among the phenolic resins, the resol type phenolic resin is preferable from the viewpoint of needlessness of a hardener such as acids or amines, from the viewpoint of reducing odor during the molding of the structure for producing a casting, and from the viewpoint of reducing casting defects in a case where the structure for producing a casting is used as a mold.

In a case of using the novolac phenolic resin, a hardener is preferred. The hardener is easily dissolved in water, and thus it is preferable that the surface thereof be coated after dehydrating the structure for producing a casting. As the hardener, hexamethylenetetramine or the like is preferably used.

The reduction ratio (obtained through TG thermal analysis measurement) of the thermosetting resin at 1000° C. in a nitrogen atmosphere is preferably 50 mass % or lower and more preferably 45 mass % or lower from the viewpoint of strongly binding the organic fiber, the inorganic fiber, and the inorganic particles during the drying and molding in the process (III).

The content of the thermosetting resin in the structure for producing a casting is, with respect to 100 parts by mass of the structure for producing a casting, preferably 5 parts by mass or more, more preferably 10 parts by mass or more, and even more preferably 15 parts by mass or more, and is preferably 40 parts by mass or less, more preferably 30 parts by mass or less, and even more preferably 20 parts by mass or less from the viewpoint of enhancing the strength of the structure for producing a casting and suppressing a gas generation amount.

The content thereof corresponds to the total amount of the thermosetting resin added in any one or some of the processes (I-1), (I-2), and (I-3) of the process (I).

Causes of an increase in the gas generation amount during casting are primarily the organic fiber and the thermosetting resin. Therefore, the raw material kinds, the blending amounts, and the mass ratios of the two are important.

By appropriately setting the content of the thermosetting resin, adhesion of the structure for producing a casting to a metallic mold can be prevented during the drying and molding in the process (III), and thus the structure for producing a casting can be easily separated from the metallic mold. Therefore, adhesion of the cured thermosetting resin to the surface of the metallic mold can be reduced, the dimensional accuracy of the structure for producing a casting can be improved, and the cleaning frequency of the surface of the metallic mold can also be reduced.

(v) Other Components

The structure for producing a casting of the invention may contain, in addition to the organic fiber, the inorganic fiber, the inorganic particles, and the thermosetting resin, a reinforcing agent for paper.

As the reinforcing agent for paper, latex, an acrylic emulsion, polyvinyl alcohol, carboxymethyl cellulose (CMC), a polyacrylamide resin, or the like may be employed.

The amount of the reinforcing agent for paper that is used is, with respect to 100 parts by mass of the structure for producing a casting in terms of solid content, preferably 0.01 part by mass or more and more preferably 0.02 part by mass or more from the viewpoint of preventing swelling, and is preferably 2 parts by mass or less and more preferably 1 part by mass or less from the viewpoint of preventing adhesion of the structure for producing a casting to the metallic mold.

The structure for producing a casting of the invention may further contain components such as a coagulant and a colorant. As the coagulant, a polyamide epichlorohydrin resin or the like may be employed.

The thickness of the structure for producing a casting may be set depending on the use or the like. However, the thickness of at least a part that comes into contact with molten metal is preferably 0.2 mm or greater, more preferably 0.4 mm or greater, even more preferably 0.5 mm or greater, and even more preferably 0.6 mm or greater from the viewpoint of enhancing the strength of the structure for producing a casting, and is preferably 5 mm or smaller, more preferably 4 mm or smaller, even more preferably 3.5 mm or smaller, and even more preferably 3.0 mm or smaller from the viewpoint of enhancing the permeability of the structure for producing a casting.

The compressive strength of the structure for producing a casting is preferably 80 N or higher and more preferably 100 N or higher from the viewpoint of maintaining the function of the structure for producing a casting.

The moisture content of the structure for producing a casting produced according to the invention before the structure is used (before the structure is provided for casting) is preferably 10 mass % or lower, more preferably 8 mass % or lower, even more preferably 5 mass % or lower, and even more preferably 3 mass % or lower from the viewpoint of reducing the gas generation amount during casting.

The density of the structure for producing a casting produced according to the invention is preferably 3 g/cm$^3$ or lower, more preferably 2 g/cm$^3$ or lower, and even more preferably 1.5 g/cm$^3$ or lower from the viewpoint of the handleability and the processing-workability of the structure for producing a casting.

<Method of Producing Structure for Producing Casting>

A method of producing the structure for producing a casting of the invention includes: a process (I) of obtaining a slurry composition containing an organic fiber, an inorganic fiber, a thermosetting resin, and water; a process (II) of obtaining a fiber laminate by subjecting the slurry composition to papermaking; and a process (III) of dehydrating the fiber laminate and thereafter drying the resultant. Furthermore, the process (I) includes a process (I-1) of beating a mixture containing the organic fiber, the thermosetting resin according to cases, and water, a process (I-2) of mixing the mixture obtained in the process (I-1), the thermosetting resin according to cases, and water, and a process (I-3) of mixing the mixture obtained in the process (I-2), the inorganic fiber, and the thermosetting resin according to cases. That is, the thermosetting resin is mixed in at least any of the process (I-1), the process (I-2), and the process (I-3). The thermosetting resin may be mixed in the process (I-1) and/or the process (I-3). The thermosetting resin may be mixed in the process (I-1). In addition, according to cases, the inorganic particles are mixed in at least any of the process (I-1), the process (I-2), and the process (I-3). In addition, according to cases, the inorganic particles may be mixed in the process (I-1) and/or the process (I-3). In addition, according to cases, the inorganic particles may be mixed in the process (I-3).

<Process (I)>

[Process (I-1)]

In the process (I-1), a mixture of the organic fiber, the thermosetting resin according to cases, the inorganic particles according to cases, and water is beaten. First, in the process (I-1), the mixture of the organic fiber, the thermosetting resin according to cases, the inorganic particles according to cases, and water as a dispersion medium is prepared. The mixture is prepared by dispersing the organic fiber and the thermosetting resin in water.

The content of the organic fiber in the raw material slurry is, with respect to 100 parts by mass of the sum of the organic fiber, the inorganic fiber, the inorganic particles, and the thermosetting resin used in the entire process (I), preferably 1 part by mass or more, more preferably 5 parts by mass or more, even more preferably 10 parts by mass or more, and even more preferably 20 parts by mass or more from the viewpoint of enhancing the moldability of the structure for producing a casting, and is, with respect to 100 parts by mass of the sum of the organic fiber, the inorganic fiber, the inorganic particles, and the thermosetting resin used in the entire process (I), preferably 40 parts by mass or less and more preferably 30 parts by mass or less from the viewpoint of suppressing a gas generation amount during casting. An amount of the organic fiber corresponding to this content is used for the preparation of the mixture of the process (I-1). In addition, in the process (I-1), in a case where the thermosetting resin and/or the inorganic particles are not used, the amounts thereof are set to 0 parts by mass to calculate 100 parts by mass of the sum (hereinafter, the same is applied).

The content of the thermosetting resin in the raw material slurry is, with respect to 100 parts by mass of the sum of the organic fiber, the inorganic fiber, the inorganic particles, and the thermosetting resin used in the entire process (I), preferably 5 parts by mass or more, more preferably 10 parts by mass or more, and even more preferably 15 parts by mass or more, and is preferably 40 parts by mass or less, more preferably 30 parts by mass or less, and even more preferably 20 parts by mass or less from the viewpoint of enhancing the strength of the structure for producing a casting and suppressing a gas generation amount during casting. An amount of the thermosetting resin corresponding to this content may be used for the preparation of the mixture of the process (I-1).

In the process (I-1), the amount of water to obtain the mixture of the organic fiber, the thermosetting resin according to cases, the inorganic particles according to cases, and water is, with respect to 100 parts by mass of the sum of the organic fiber, the inorganic fiber, the inorganic particles, and the thermosetting resin used in the entire process (I), preferably 600 parts by mass or more, more preferably 700 parts by mass or more, and even more preferably 770 parts by mass or more, and is preferably 1000 parts by mass or less, more preferably 900 parts by mass or less, and even more preferably 870 parts by mass or less from the viewpoint of enhancing beating efficiency.

The content of the organic fiber in the mixture containing water before the beating in the process (I-1) is preferably 0.1 mass % or more, more preferably 0.48 mass % or more, even more preferably 1.0 mass % or more, and even more preferably 1.9 mass % or more from the viewpoint of enhancing the moldability of the structure for producing a casting, and is preferably 6.2 mass % or less and more preferably 4.7 mass % or less from the viewpoint of suppressing a gas generation amount during casting.

In a case where the thermosetting resin is used in the process (I-1), the content of the thermosetting resin in the mixture containing water before the beating in the process (I-1) is preferably 0.48 mass % or more, more preferably 1.0 mass % or more, and even more preferably 1.4 mass % or more from the viewpoint of enhancing the strength of the structure for producing a casting, and is preferably 6.2 mass % or less, more preferably 4.7 mass % or less, and even more preferably 3.1 mass % or less from the viewpoint of suppressing a gas generation amount during casting.

Although described later, a portion or the entirety of the thermosetting resin used in the process (I) may be used in the process (I-2) and/or the process (I-3). In the case where a portion of the thermosetting resin is used in the process (I-1), the ratio of the amount thereof to the amount used in the process (I-2) and/or the process (I-3) is not particularly limited. Preferably, the total amount of the thermosetting resin used in the process (I) is mixed in the process (I-1).

The content of water in the mixture containing water before the beating in the process (I-1) is preferably 87.6 mass % or more and more preferably 92.2 mass % or more from the viewpoint of suppressing a gas generation amount during casting, and is preferably 99.4 mass % or less, more preferably 98.0 mass % or less, and even more preferably 96.7 mass % or less from the viewpoint of enhancing the moldability of the structure for producing a casting.

In addition, in the process (I-1), a dispersion medium other than water may also be used. As the dispersion medium other than water, a solvent such as ethanol, methanol, dichloromethane, acetone, or xylene may be employed. The media may be used singly or in a combination of two or more thereof.

Next, the obtained mixture is beaten. The raw material slurry is disaggregated in a pulper at a predetermined frequency for a predetermined time and is thereafter sent to a refiner so as to be subjected to a beating treatment at a predetermined strength for a predetermined time.

Specifically, the mixture of the organic fiber, the thermosetting resin according to cases, the inorganic particles according to cases, and water is fed into the pulper and 2000 kg of the mixture is disaggregated at a frequency of preferably 10 Hz or higher, more preferably 20 Hz or higher, and even more preferably 30 Hz or higher from the viewpoint of enhancing disaggregation efficiency, and at a frequency of preferably 200 Hz or lower, more preferably 150 Hz or lower, and even more preferably 100 Hz or lower from the viewpoint of reducing power consumption. The disaggregation time is preferably 1 minute or longer, more preferably 2 minutes or longer, and even more preferably 3 minutes or longer from the viewpoint of enhancing disaggregation efficiency, and is preferably 30 minutes or shorter, more preferably 25 minutes or shorter, and even more preferably 20 minutes or shorter from the viewpoint of reducing power consumption.

In addition, the beating of the mixture of the organic fiber, the thermosetting resin according to cases, the inorganic particles according to cases, and water, preferably, a mixture of the organic fiber, the thermosetting resin, the inorganic particles according to cases, and water after the disaggregation is preferably performed by using a beating means selected from a refiner, a beater, and a PFI mill, and is more preferably performed by using a refiner from the viewpoint of beating efficiency. The load value in the case of using the refiner is preferably 5 kW or higher, more preferably 7 kW or higher, and even more preferably 10 kW or higher from the viewpoint of enhancing beating efficiency, and is preferably 50 kW or lower, more preferably 30 kW or lower, and even more preferably 20 kW or lower from the viewpoint of reducing power consumption. The flow rate in the case of using the refiner is preferably 10 L/min or higher, more preferably 20 L/min or higher, and even more preferably 30 L/min or higher from the viewpoint of enhancing production efficiency, and is preferably 200 L/min or lower, more preferably 150 L/min or lower, and even more preferably 130 L/min or lower from the viewpoint of enhancing beating efficiency. The treatment time in the case of using the refiner is preferably 5 minute or longer, more preferably 8 minutes or longer, and even more preferably 10 minutes or longer from the viewpoint of enhancing beating efficiency, and is preferably 90 minutes or shorter, more preferably 80 minutes or shorter, and even more preferably 70 minutes or shorter from the viewpoint of enhancing production efficiency.

[Process (I-2)]

In the process (I-2), the mixture obtained in the process (I-1), the thermosetting resin according to cases, and water are mixed with each other. That is, the mixture subjected to the beating treatment is mixed with the thermosetting resin according to cases and water as the dispersion medium. The mixing may be performed by conveying the mixture to a tank and thereafter supplying water thereto, or by conveying the mixture to a tank in which water is contained in advance. The amount of water mixed in the process (I-2) is, with respect to 100 parts by mass of the sum of the organic fiber, the inorganic fiber, the inorganic particles, and the thermosetting resin used in the entire process (I), preferably 2100 parts by mass or more, more preferably 2200 parts by mass or more, and even more preferably 2300 parts by mass or more, and is preferably 2700 parts by mass or less, more preferably 2600 parts by mass or less, and even more preferably 2500 parts by mass or less from the viewpoint of enhancing the surface smoothness of the structure for producing a casting.

The content of the organic fiber in the mixture obtained in the process (I-2) is preferably 0.03 mass % or more, more preferably 0.14 mass % or more, even more preferably 0.28 mass % or more, and even more preferably 0.57 mass % or more from the viewpoint of enhancing the moldability of the structure for producing a casting, and is preferably 1.4 mass % or less and more preferably 1.0 mass % or less from the viewpoint of suppressing a gas generation amount during casting.

In a case where the inorganic particles are used in the process (I-1), the content of the inorganic particles in the mixture obtained in the process (I-2) is more preferably 0.2 mass % or more, and even more preferably 0.54 mass % or more from the viewpoint of enhancing hot strength during the casting of the structure for producing a casting, and is preferably 3 mass % or less, more preferably 2.6 mass % or less, and even more preferably 2 mass % or less from the viewpoint of enhancing the strength of the structure for producing a casting.

In a case where the thermosetting resin is used in the process (I-1) or the process (I-2), the content of the thermosetting resin in the mixture obtained in the process (I-2) is preferably 0.14 mass % or more, more preferably 0.28 mass % or more, and even more preferably 0.43 mass % or more from the viewpoint of enhancing the moldability of the structure for producing a casting, and is preferably 1.4 mass % or less, and more preferably 1.0 mass % or less from the viewpoint of suppressing a gas generation amount during casting.

The amount of water in the mixture obtained in the process (I-2) is preferably 97.0 mass % or more, more preferably 98.0 mass % or more, and even more preferably 98.4 mass % or more from the viewpoint of suppressing the generation of lumps during the inorganic fiber is mixed in the process (I-3) and enhancing the surface smoothness of the structure for producing a casting, and is preferably 99.7 mass % or less, more preferably 99.4 mass % or less, and even more preferably 99.0 mass % or less from the viewpoint of enhancing the moldability of the structure for producing a casting.

[Process (I-3)]

In the process (I-3), the mixture obtained in the process (I-2), the organic fiber, the thermosetting resin according to cases, and the inorganic particles according to cases are mixed with each other. Accordingly, the slurry composition (raw material slurry) of the process (I), which contains the organic fiber, the inorganic fiber, the inorganic particles, the thermosetting resin, and water is obtained.

The content of the inorganic fiber in the raw material slurry is, with respect to 100 parts by mass of the sum of the organic fiber, the inorganic fiber, the inorganic particles, and the thermosetting resin used in the entire process (I), preferably 1 part by mass or more, more preferably 2 parts by mass or more, and even more preferably 3 parts by mass or more from the viewpoint of enhancing the strength of the structure for producing a casting, suppressing thermal contraction, and enhancing resistance of metal penetration, and is preferably 6 parts by mass or less, more preferably 5 parts by mass or less, and even more preferably 4 parts by mass or less from the viewpoint of suppressing the generation of lumps during the slurry preparation in the process (I) and enhancing the surface smoothness of the structure for producing a casting. An amount of the inorganic fiber corresponding to this content is used in the process (I-3). Preferably, the total amount of the inorganic fiber used in the entire process (I), that is, the total amount of the inorganic fiber mixed in the raw material slurry is used in the process (I-3). In addition, in the process (I), in a case where the inorganic particles are not used, the amount thereof is set to 0 parts by mass to calculate 100 parts by mass of the sum.

As described above, a portion or the entirety of the thermosetting resin used in the process (I) may be used in, in addition to the process (I-3), the process (I-1) and/or the process (I-2). In the case where a portion of the thermosetting resin is used in the process (I-3), the ratio of the amount thereof to the amount used in the process (I-1) and/or the process (I-2) is not particularly limited.

The content of the inorganic particles in the raw material slurry used according to cases is, with respect to 100 parts by mass of the sum of the organic fiber, the inorganic fiber, the inorganic particles, and the thermosetting resin used in the entire process (I), preferably 10 parts by mass or more, more preferably 20 parts by mass or more, and even more preferably 40 parts by mass or more from the viewpoint of enhancing hot strength during the casting of the structure for producing a casting, and is preferably 80 parts by mass or less, more preferably 70 parts by mass or less, and even more preferably 60 parts by mass or less from the viewpoint of enhancing the strength of the structure for producing a casting. An amount of the inorganic particles corresponding to this content may be divided into amounts used in the process (I-1) or the process (I-3), or the process (I-1) and the process (I-3). In the case of using the inorganic particles, the inorganic particles are preferably mixed in the process (I), and more preferably, the total amount of the inorganic particles used in the process (I) is mixed in the process (I-3).

A reinforcing agent for paper may be added to the raw material slurry. As the reinforcing agent for paper, latex, an acrylic emulsion, polyvinyl alcohol, carboxymethyl cellulose (CMC), a polyacrylamide resin, or the like may be employed.

The amount of the reinforcing agent for paper that is used is, with respect to 100 parts by mass of the sum of the organic fiber, the inorganic fiber, the inorganic particles, and the thermosetting resin used in the entire process (I) in terms of solid content, preferably 0.01 part by mass or more and more preferably 0.02 part by mass or more from the viewpoint of preventing swelling of the structure for producing a casting, and is preferably 0.2 part by mass or less and more preferably 0.1 part by mass or less from the viewpoint of preventing adhesion of the structure for producing a casting to the metallic mold.

During the production of the structure for producing a casting of the invention, components of a coagulant may further be added. As the coagulant, a polyamide epichlorohydrin resin or the like may be employed.

The amount of the coagulant that is used is, with respect to 100 parts by mass of the sum of the organic fiber, the inorganic fiber, the inorganic particles, and the thermosetting resin used in the entire process (I) in terms of solid content, preferably 0.02 part by mass or more, more preferably 0.05 part by mass or more, and even more preferably 0.1 part by mass or more from the viewpoint of enhancing cohesive force, and is preferably 2 parts by mass or less, more preferably 1.5 parts by mass or less, and even more preferably 0.9 part by mass or less from the viewpoint of suppressing a gas generation amount of the structure for producing a casting.

The average fiber length of the inorganic fiber in the raw material slurry is preferably 1 mm or longer and more preferably 2 mm or longer from the viewpoint of enhancing the strength of the structure for producing a casting and suppressing thermal contraction, and is preferably 5 mm or shorter and more preferably 4 mm or shorter from the viewpoint of enhancing the moldability of the structure for producing a casting.

The ratio of the major axis to the minor axis of the inorganic fiber, preferably the carbon fiber in the raw material slurry is preferably 1 or higher, more preferably 10 or higher, and even more preferably 50 or higher, and is preferably 5000 or lower, more preferably 2000 or lower, and even more preferably 1000 or lower from the viewpoint of enhancing the strength of the structure for producing a casting, from the viewpoint of enhancing the moldability of the structure for producing a casting, and from the viewpoint of suppressing the thermal contraction of the structure for producing a casting.

From the viewpoint of enhancing the surface smoothness of the structure for producing a casting, in the process (I), the inorganic fiber is used in a proportion of, with respect to the amount of water with which the inorganic fiber is initially mixed, preferably 0.14 mass % or less, more preferably 0.13 mass % or less, and even more preferably 0.12 mass % or less, and of preferably 0.01 mass % or more, more preferably 0.03 mass % or more, and even more preferably 0.06 mass % or more. In the invention, the inorganic fiber used in the process (I-3) is used in a proportion of, with respect to the amount of water used in the processes (I-1) and (I-2), preferably 0.14 mass % or less, more preferably 0.13 mass % or less, and even more preferably 0.12 mass % or less, and of preferably 0.01 mass % or more, more preferably 0.03 mass % or more, and even more preferably 0.06 mass % or more.

The content of the entire solid content in the slurry composition obtained in the process (I) is preferably 1 mass % or more, more preferably 2 mass % or more, and even more preferably 2.5 mass % or more, and is preferably 5 mass % or less, more preferably 4 mass % or less, and even more preferably 3.5 mass % or less from the viewpoint of enhancing the moldability of the structure for producing a casting.

The content of the organic fiber in the slurry composition obtained in the process (I) is preferably 0.03 mass % or more, more preferably 0.14 mass % or more, even more preferably 0.28 mass % or more, and even more preferably 0.55 mass % or more from the viewpoint of enhancing the moldability of the structure for producing a casting, and is preferably 3 mass % or less, more preferably 1.3 mass % or less, and even more preferably 1 mass % or less from the viewpoint of suppressing a gas generation amount during casting.

The content of the thermosetting resin in the slurry composition obtained in the process (I) is preferably 0.14 mass % or more, more preferably 0.28 mass % or more, and even more preferably 0.41 mass % or more from the viewpoint of enhancing the strength of the structure for producing a casting, and is preferably 1.3 mass % or less, more preferably 1 mass % or less, and even more preferably 0.7 mass % or less from the viewpoint of suppressing a gas generation amount during casting.

The content of the inorganic fiber in the slurry composition obtained in the process (I) is preferably 0.03 mass % or more, more preferably 0.06 mass % or more, and even more preferably 0.08 mass % or more from the viewpoint of enhancing the strength of the structure for producing a casting, suppressing thermal contraction, and enhancing resistance of metal penetration, and is preferably 0.2 mass % or less, more preferably 0.17 mass % or less, and even more preferably 0.13 mass % or less from the viewpoint of suppressing the generation of lumps during the slurry preparation in the process (I) and enhancing the surface smoothness of the structure for producing a casting.

The content of the inorganic particles in the case of being used in the slurry composition obtained in the process (I) is preferably 0.3 mass % or more, more preferably 0.6 mass % or more, and even more preferably 1.1 mass % or more from the viewpoint of enhancing the hot strength of the structure for producing a casting, and is preferably 2.6 mass % or less, more preferably 2.3 mass % or less, and even more preferably 2.0 mass % or less from the viewpoint of suppressing the generation of lumps during the slurry preparation in the process (I) and enhancing the strength of the structure for producing a casting.

In the case where the slurry composition obtained in the process (I) contains a reinforcing agent for paper, the content of the reinforcing agent for paper in the slurry composition is preferably 0.0003 mass % or more and more preferably 0.0006 mass % or more from the viewpoint of preventing swelling of the structure for producing a casting, and is preferably 0.007 mass % or less and more preferably 0.003 mass % or less from the viewpoint of preventing adhesion of the structure for producing a casting to the metallic mold.

In the case where the slurry composition obtained in the process (I) contains the coagulant, the content of the coagulant in the slurry composition is preferably 0.01 mass % or more, more preferably 0.02 mass % or more, and even more preferably 0.05 mass % or more from the viewpoint of enhancing cohesive force, and is preferably 0.4 mass % or less, more preferably 0.2 mass % or less, and even more preferably 0.1 mass % or less from the viewpoint of suppressing the gas generation amount of the structure for producing a casting.

A preferable value of the mass ratio of the organic fiber to the inorganic fiber in the slurry composition obtained in the process (I) is the same as the mass ratio of the organic fiber to the inorganic fiber in the structure for producing a casting.

To the raw material slurry, as necessary, additives such as a colorant and a preservative may be added.

<Process (II)>

In the process (II), a fiber laminate is obtained by subjecting the slurry composition obtained in the process (I) to papermaking. That is, the raw material slurry is used to produce the structure for producing a casting through papermaking by reducing a water content of the raw material slurry and molding the components of the slurry.

In the papermaking of the slurry composition (the raw material slurry) obtained in the process (I), for example, a metallic mold in which two split molds forming a group are mated to each other so as to form a cavity therein, which has a shape substantially corresponding to the external form of the structure for producing a casting and is open toward the outside may be used.

Each of the split molds is provided with a large number of communication holes that allow the cavity to communicate with the outside, and the inner surface of each of the split molds is coated with a net having a mesh with a predetermined size. In addition, while a predetermined amount of the raw material slurry is injected into the cavity of the metallic mold by using a pressure feed pump or the like, the liquid content is suctioned and discharged through the communication holes such that the solid content of the raw material slurry is deposited on the net. The pressure for feeding the raw material slurry is: from the viewpoint of enhancing production efficiency, preferably 0.01 MPa or higher, more preferably 0.05 MPa or higher, and even more preferably 0.1 MPa or higher; and from the viewpoint of uniformly feeding the raw material slurry into the metallic mold, preferably 5 MPa or lower, more preferably 2 MPa or lower, and even more preferably 0.5 MPa or lower.

When the fiber laminate having a predetermined thickness is formed on the net by injecting the predetermined amount of the raw material slurry, the injection of the raw material slurry under pressure is stopped.

<Process (III)>

In the process (III), the fiber laminate obtained in the process (II) is dehydrated and is thereafter dried. By injecting the air into the cavity under pressure or the like, the fiber laminate obtained in the process (II) is dehydrated to have a predetermined moisture content.

Next, the fiber laminate is dried and molded. In the drying and molding process, a drying mold in which a cavity which has a shape substantially corresponding to the external form of the structure for producing a casting to be molded by mating split molds forming a group and is open toward the outside is formed may be used. In addition, the drying mold is heated to a predetermined temperature, and the dehydrated fiber laminate is loaded in the drying mold.

Next, a core (elastic core) which has elasticity so as to be stretchable and has a hollow shape is inserted into the cavity, and a pressurized fluid is supplied into the core to inflate the core in the cavity. In addition, the fiber laminate is pressed against the formation surface of the cavity and is dried while being shaped to have a transferred shape of the inner surface. As the core, for example, urethane, a fluorine-based rubber, a silicone-based rubber, or an elastomer rubber may be used.

As the pressurized fluid that inflates the core, for example, compressed air, preferably heated compressed air, oil, preferably heated oil, and other various liquids may be employed. The pressure at which the pressurized fluid is supplied is preferably 0.01 MPa or higher, more preferably 0.05 MPa or higher, and even more preferably 0.1 MPa or higher from the viewpoint of enhancing the smoothness of the inner surface of a molded product, and is preferably 5 MPa or lower, more preferably 2 MPa or lower, and even more preferably 0.5 MPa or lower from the viewpoint of enhancing the life span of the core.

The heating temperature (metallic mold temperature) of the drying mold is 180° C. or higher and more preferably 200° C. or higher from the viewpoint of reducing the drying time, and is 250° C. or lower and more preferably 240° C. or lower from the viewpoint of preventing the deterioration of surface properties due to burns.

After drying the fiber laminate, the pressurized fluid in the core is extracted to allow the core to shrink and be taken out of the fiber laminate. In addition, the drying mold is opened, and the dried and molded structure for producing a casting is released.

The structure for casting a casting obtained as described above is a noble structure in which the inorganic fiber length is maintained.

That is, in the structure for producing a casting obtained as described above, the components including the organic fiber, the inorganic fiber, the thermosetting resin, and the inorganic particles contained according to cases are uniformly dispersed without unevenness, and thus the occurrence of cracking or the like caused by thermal contraction is suppressed, and thus high hot strength is obtained, thereby providing excellent surface smoothness. In addition, the fiber laminate is pressed from its inside against the formation surface of the cavity of a dry mold by the core, and molded, and thus, inner and outer surfaces have a high surface smoothness.

Therefore, when the structure for producing a casting is used to produce a casting, the obtained casting has particularly excellent surface smoothness. In addition, even in a case where the structure for producing a casting has a hollow shape or a complex three-dimensional shape, a joining process is unnecessary. Therefore, in a mold or the like that is finally obtained, joints and thick portions due to the joining process are not present. Even in this aspect, the thickness thereof is uniform. Therefore, a casting having high molding accuracy, high mechanical strength, high dimensional accuracy, and excellent surface smoothness can be produced. Therefore, the structure for producing a casting is also applicable to produce a structure having fitting portions or screw portions such as a runner as well as a mold or a core. In a case where there is concern about the generation of gas defects due to the material or shape of a casting, a mold or the like may also be subjected to a heat treatment in advance at a temperature of 200° C. or higher and 250° C. or lower in a reductive atmosphere.

<Method of Producing Casting>

Next, a method of producing a casting of the invention will described on the basis of the preferred embodiment.

In the producing method of this embodiment, the structure for producing a casting of the present invention obtained as described above is embedded at a predetermined position in molding sand to build a mold. The structure for producing a casting produced according to the invention can be used as a mold or a structure used to produce a casting. As the molding sand, typical sand used to produce this type of casting hitherto can be used without particular limitations. In addition, the molding sand may not be cured with a binder but may also be cured as necessary. In a case where the structure for producing a casting is a hollow core, the core may not necessarily be filled with the molding sand but may also be filled with the molding sand.

In addition, casting is performed by pouring molten metal from the pouring gate. At this time, the corresponding thermosetting resin and the organic fiber are thermally decomposed and carbonized. However, thermal contraction caused by the pyrolysis is suppressed by the inorganic fiber. Therefore, cracking in the mold and the like rarely occurs, and the mold and the like are rarely broken. In addition, penetration of the molten metal into the mold and the like or attachment of cast sand and the like rarely occur. In addition, the surface smoothness of the mold and the like is maintained by the carbonized film generated by the pyrolysis, and thus the surface smoothness of the obtained casting is also improved.

After the casting is finished, cooling to a predetermined temperature is performed, the molding flask is disassembled to remove the molding sand, and the structure for producing a casting is removed by further performing a blasting treatment to expose the casting. At this time, since the organic fiber is decomposed by heat, a treatment of removing the mold and the like is easily performed. Thereafter, a post treatment such as a trimming treatment may be performed on the casting as necessary, and the production of the casting is completed.

In the method of producing the casting of this embodiment, since the mold containing the organic fiber, the inorganic fiber, and the inorganic particles and the thermosetting resin according to cases and the like are used, the hot strength can be maintained by the inorganic fiber and the thermosetting resin. Therefore, a casting having excellent dimensional accuracy and surface smoothness can be produced. In addition, since a void is formed inside the structure for producing a casting by the pyrolysis of the organic fiber and the like, the removal of the structure for producing a casting can be easily performed. Therefore, waste disposal can be simply performed compared to the related art, and the amount of waste generated can also be significantly suppressed. Accordingly, an effort to perform the treatment can also be significantly reduced. Furthermore, the molding sand does not necessarily need to be cured by a binder, and thus a regeneration treatment of the molding sand is simply performed.

The invention is not limited to the above-described embodiments and can be appropriately changed without departing from the concept of the invention.

Regarding the structure for producing a casting of the invention, when a structure for producing a casting having a three-dimensional hollow shape and the like are to be formed as in the above embodiments, it is preferable that the structure for producing a casting be produced through papermaking of a molded body according to a wet papermaking method, dehydrating, and drying and molding processes. However, the structure for producing a casting may also be produced by forming a sheet-like molded body through papermaking of the raw material slurry and winding up the resultant as a paper core.

In addition, it is preferable to produce the structure for producing a casting to obtain a shape corresponding to the final shape after the drying and molding process. However, the structure for producing a casting may also be produced in a form in which a molded body obtained after the drying is cut and divided, and the divided parts are connected by fitting, screwing, or the like. In this case, it is preferable that the molded body be molded in a form in which the end portions and the divided parts thereof are provided with fitting or screwing portions in advance.

The method of producing the casting of the invention may also be applied to casting of, in addition to cast iron, aluminum and an alloy thereof, copper and an alloy thereof, nickel, and non-ferrous metal such as lead.

Regarding the above-described embodiments, the invention further discloses the following producing methods.

<1> A method of producing a structure for producing a casting, the method including:

a process (I) of obtaining a slurry composition containing an organic fiber, an inorganic fiber, a thermosetting resin, and water;

a process (II) of obtaining a fiber laminate by subjecting the slurry composition to papermaking; and a process (III) of dehydrating the fiber laminate and thereafter drying the resultant, wherein the process (I) includes a process (I-1) of beating a mixture containing the organic fiber and water, a process (I-2) of mixing the mixture obtained in the process (I-1) and water, and a process (I-3) of mixing the mixture obtained in the process (I-2) and the inorganic fiber, the thermosetting resin is mixed in at least any of the process (I-1), the process (I-2), and the process (I-3), and an average fiber length of the inorganic fiber in the structure for producing a casting is 1 mm or longer and 5 mm or shorter.

<2> A method of producing a structure for producing a casting, the method including:

a process (I) of obtaining a slurry composition containing an organic fiber, an inorganic fiber, inorganic particles, a thermosetting resin, and water;

a process (II) of obtaining a fiber laminate by subjecting the slurry composition to papermaking; and a process (III) of dehydrating the fiber laminate and thereafter drying the resultant, wherein the process (I) includes a process (I-1) of beating a mixture containing the organic fiber and water, a process (I-2) of mixing the mixture obtained in the process (I-1) and water, and a process (I-3) of mixing the mixture obtained in the process (I-2) and the inorganic fiber, the thermosetting resin is mixed in at least any of the process (I-1), the process (I-2), and the process (I-3), the inorganic particles are mixed in at least any of the process (I-1), the process (I-2), and the process (I-3), and an average fiber length of the inorganic fiber in the structure for producing a casting is 1 mm or longer and 5 mm or shorter.

<3> A method of producing a structure for producing a casting, the method including:

a process (I) of obtaining a slurry composition containing an organic fiber, an inorganic fiber, inorganic particles, a thermosetting resin, and water;

a process (II) of obtaining a fiber laminate by subjecting the slurry composition to papermaking; and a process (III) of dehydrating the fiber laminate and thereafter drying the resultant, wherein the process (I) includes a process (I-1) of beating a mixture containing the organic fiber, the thermosetting resin, and water, a process (I-2) of mixing the mixture obtained in the process (I-1) and water, and a process (I-3) of mixing the mixture obtained in the process (I-2), the inorganic fiber, and the inorganic particles, an average fiber length of the inorganic fiber in the structure for producing a casting is 1 mm or longer and 5 mm or shorter.

<4> The method of producing a structure for producing a casting described in any of <1> to <3>, wherein a content of the inorganic fiber in the structure for producing a casting is, with respect to 100 parts by mass of the structure for producing a casting, preferably 1 part by mass or more, more preferably 2 parts by mass or more, and even more preferably 3 parts by mass or more, and is preferably 6 parts by mass or less, more preferably 5 parts by mass or less, and even more preferably 4 parts by mass or less.

<5> The method of producing a structure for producing a casting described in any of <1> to <4>, wherein, in the process (I), the inorganic fiber is used in a proportion of, with respect to an amount of the water with which the inorganic fiber is initially mixed, preferably 0.14 mass % or less, more preferably 0.13 mass % or less, and even more preferably 0.12 mass % or less, and of preferably 0.01 mass % or more, more preferably 0.03 mass % or more, and even more preferably 0.06 mass % or more.

<6> The method of producing a structure for producing a casting described in any of <1> to <5>, wherein the average fiber length of the inorganic fiber used in the process (I) is preferably 1 mm or longer and more preferably 2 mm or longer, and is preferably 5 mm or shorter and more preferably 4 mm or shorter.

<7> The method of producing a structure for producing a casting described in any of <1> to <6>, wherein the inorganic fiber is preferably one or more types selected from a carbon fiber, rock wool, a ceramic fiber, a natural mineral fiber, a glass fiber, a silica fiber, and a metallic fiber, and is more preferably a carbon fiber.

<8> The method of producing a structure for producing a casting described in any of <1> to <7>, wherein the average fiber length of the inorganic fiber in the structure for producing a casting is preferably 1 mm or longer and more preferably 2 mm or longer, and is preferably 5 mm or shorter and more preferably 4 mm or shorter.

<9> The method of producing a structure for producing a casting described in any of <1> to <8>, wherein a ratio of a major axis to a minor axis of the inorganic fiber, preferably the carbon fiber in the structure for producing a casting is preferably 1 or higher, more preferably 10 or higher, and even more preferably 50 or higher, and is preferably 5000 or lower, more preferably 2000 or lower, and even more preferably 1000 or lower.

<10> The method of producing a structure for producing a casting described in any of <1> to <9>, wherein a content of the entire solid content in the slurry composition obtained in the process (I) is preferably 1 mass % or more, more preferably 2 mass % or more, and even more preferably 2.5 mass % or more, and is preferably 5 mass % or less, more preferably 4 mass % or less, and even more preferably 3.5 mass % or less.

<11> The method of producing a structure for producing a casting described in any of <1> to <9>, wherein a content of the organic fiber in the structure for producing a casting is, with respect to 100 parts by mass of the structure for producing a casting, preferably 1 part by mass or more, more preferably 5 parts by mass or more, even more preferably 10 parts by mass or more, and even more preferably 20 parts by mass or more, and is preferably 40 parts by mass or less, and more preferably 30 parts by mass or less.

<12> The method of producing a structure for producing a casting described in any of <2> to <11>, wherein a content of the inorganic particles in the structure for producing a casting is, with respect to 100 parts by mass of the structure for producing a casting, preferably 10 parts by mass or more, more preferably 20 parts by mass or more, and even more preferably 40 parts by mass or more, and is preferably 30 parts by mass or less, more preferably 70 parts by mass or less, and even more preferably 60 parts by mass or less, provided that the method includes the configuration of <2> or <3>.

<13> The method of producing a structure for producing a casting described in any of <1> to <12>, wherein a content of the thermosetting resin in the structure for producing a casting is, with respect to 100 parts by mass of the structure for producing a casting, preferably 5 parts by mass or more, more preferably 10 parts by mass or more, and even more preferably 15 parts by mass or more, and is preferably 40 parts by mass or less, more preferably 30 parts by mass or less, and even more preferably 20 parts by mass or less.

<14> The method of producing a structure for producing a casting described in any of <1> to <13>, wherein an average fiber length of the organic fiber in the structure for producing a casting is preferably 0.8 mm or longer and more preferably 0.9 mm or longer, and is preferably 2 mm or shorter, more preferably 1.8 mm or shorter, and even more preferably 1.5 mm or shorter.

<15> The method of producing a structure for producing a casting described in any of <1> to <14>, wherein the organic fiber is preferably one or more types selected from a paper fiber, a fibrillated synthetic fiber, and a regenerated fiber, and is more preferably a paper fiber.

<16> The method of producing a structure for producing a casting described in any of <2> to <15>, wherein the inorganic particles are preferably one or more types selected from obsidian, graphite, mica, silica, hollow ceramic, and fly ash, and are more preferably obsidian, provided that the method includes the configuration of <2> or <3>.

<17> The method of producing a structure for producing a casting described in any of <2> to <16>, wherein an average particle diameter of the inorganic particles is preferably 10 μm or longer and more preferably 20 μm or longer, and is preferably 60 μm or shorter and 40 μm or shorter, provided that the method includes the configuration of <2> or <3>.

<18> The method of producing a structure for producing a casting described in any of <1> to <17>, wherein the thermosetting resin is preferably one or more types selected from a phenolic resin, an epoxy resin, and a furan resin, and is more preferably a phenolic resin.

<19> The method of producing a structure for producing a casting described in any of <1> to <18>, wherein a mass ratio of the organic fiber to the inorganic fiber, preferably a mass ratio of the organic fiber to the carbon fiber in the structure for producing a casting is, in terms of inorganic fiber/organic fiber, furthermore, preferably carbon fiber/organic fiber, preferably 0.05 or higher, more preferably 0.1 or higher, and even more preferably 0.12 or higher, and is preferably 1.0 or lower and more preferably 0.5 or lower.

<20> The method of producing a structure for producing a casting described in any of <1> to <19>, wherein a content of the organic fiber in the slurry composition obtained in the process (I) is, with respect to 100 parts by mass of the sum of the organic fiber, the inorganic fiber, the inorganic particles, and the thermosetting resin used in the entire process (I), preferably 1 part by mass or more, more preferably 5 parts by mass or more, even more preferably 10 parts by mass or more, and even more preferably 20 parts by mass or more, and is preferably 40 parts by mass or less and more preferably 30 parts by mass or less.

<21> The method of producing a structure for producing a casting described in any of <1> to <20>, wherein a content of the organic fiber in the mixture containing water before the beating in the process (I-1) is preferably 0.1 mass % or more, more preferably 0.43 mass % or more, even more preferably 1.0 mass % or more, and even more preferably 1.9 mass % or more, and is preferably 6.2 mass % or less and more preferably 4.7 mass % or less.

<22> The method of producing a structure for producing a casting described in any of <1> to <21>, wherein a content of the thermosetting resin in the slurry composition obtained in the process (I) is, with respect to 100 parts by mass of the sum of the organic fiber, the inorganic fiber, the inorganic particles, and the thermosetting resin used in the entire process (I), preferably 5 parts by mass or more, more preferably 10 parts by mass or more, and even more preferably 15 parts by mass or more, and is preferably less than 40 parts by mass, more preferably 30 parts by mass or less, and even more preferably 20 parts by mass or less.

<23> The method of producing a structure for producing a casting described in any of <1> to <22>, wherein the thermosetting resin is mixed in the process (I-1), and a content of the thermosetting resin in the mixture containing water before the beating in the process (I-1) is preferably 0.48 mass % or more, more preferably 1.0 mass % or more, and even more preferably 1.4 mass % or more, and is preferably 6.2 mass % or less, more preferably 4.7 mass % or less, and even more preferably 3.1 mass % or less.

<24> The method of producing a structure for producing a casting described in any of <1> to <23>, wherein the thermosetting resin is mixed in the process (I-1), and an amount of water to obtain the mixture of the organic fiber, the thermosetting resin, and water in the process (I-1) is, with respect to 100 parts by mass of the sum of the organic fiber, the inorganic fiber, the inorganic particles, and the thermosetting resin used in the entire process (I), preferably 600 parts by mass or more, more preferably 700 parts by mass or more, and even more preferably 770 parts by mass or more, and is preferably 1000 parts by mass or less, more preferably 900 parts by mass or less, and even more preferably 870 parts by mass or less.

<25> The method of producing a structure for producing a casting described in any of <1> to <24>, wherein an amount of water mixed in the process (I-2) is, with respect to 100 parts by mass of the sum of the organic fiber, the inorganic fiber, the inorganic particles, and the thermosetting resin used in the entire process (I), preferably 2100 parts by mass or more, more preferably 2200 parts by mass or more, and even more preferably 2300 parts by mass or more, and is preferably 2700 parts by mass or less, more preferably 2600 parts by mass or less, and even more preferably 2500 parts by mass or less.

<26> The method of preferably 0.03 mass % or producing a structure for producing a casting described in any of <1> to <25>, wherein a content of the organic fiber in the mixture obtained in the process (I-2) is more, more preferably 0.14 mass % or more, even more preferably 0.28 mass % or more, and even more preferably 0.57 mass % or more, and is preferably 1.4 mass % or less and more preferably 1.0 mass % or less.

<27> The method of producing a structure for producing a casting described in any of <1> to <26>, wherein the thermosetting resin is mixed in the process (I-1), and the content of the thermosetting resin in the mixture obtained in the process (I-2) is preferably 0.14 mass % or more, more preferably 0.28 mass % or more, and even more preferably 0.43 mass % or more, and is preferably 1.4 mass % or less, more preferably 1.0 mass % or less, and even more preferably 1.4 mass % or less.

<28> The method of producing a structure for producing a casting described in any of <1> to <27>, wherein the amount of water in the mixture obtained in the process (I-2) is preferably 97.0 mass % or more, more preferably 98.0 mass % or more, and even more preferably 98.4 mass % or more, and is preferably 99.7 mass % or less, more preferably 99.4 mass % or less, and even more preferably 99.0 mass % or less.

<29> The method of producing a structure for producing a casting described in any of <1> to <28>, wherein a content of the inorganic fiber in the slurry composition obtained in the process (I) is, with respect to 100 parts by mass of the sum of the organic fiber, the inorganic fiber, the inorganic particles, and the thermosetting resin used in the entire process (I), preferably 1 part by mass or more, more preferably 2 parts by mass or more, and even more preferably 3 parts by mass or more, and is preferably 6 parts by mass or less, more preferably 5 parts by mass or less, and even more preferably 4 parts by mass or less.

<30> The method of producing a structure for producing a casting described in any of <2> to <29>, wherein the slurry composition obtained in the process (I) contains the inorganic particles, and the content of the inorganic particles in the slurry composition obtained in the process (I) is, with respect to 100 parts by mass of the sum of the organic fiber, the inorganic fiber, the inorganic particles, and the thermosetting resin used in the entire process (I), preferably 10 parts by mass or more, more preferably 20 parts by mass or more, and even more preferably 40 parts by mass or more, and is preferably 80 parts by mass or less, more preferably 70 parts by mass or less, and even more preferably 60 parts by mass or less, provided that the configuration of <2> or <3> is further included.

<31> The method of producing a structure for producing a casting described in any of <1> to <30>, wherein the content of the organic fiber in the slurry composition obtained in the process (I) is preferably 0.03 mass % or more, more preferably 0.14 mass % or more, even more preferably 0.28 mass % or more, and even more preferably 0.55 mass % or more, and is preferably 3 mass % or less, more preferably 1.3 mass % or less, and even more preferably 1 mass % or less.

<32> The method of producing a structure for producing a casting described in any of <1> to <31>, wherein the content of the thermosetting resin in the slurry composition obtained in the process (I) is preferably 0.14 mass % or more, more preferably 0.28 mass % or more, and even more preferably 0.41 mass % or more, and is preferably 1.3 mass % or less, more preferably 1 mass % or less, and even more preferably 0.7 mass % or less.

<33> The method of producing a structure for producing a casting described in any of <1> to <32>, wherein the content of the inorganic fiber in the slurry composition obtained in the process (I) is preferably 0.03 mass % or more, more preferably 0.06 mass % or more, and even more preferably 0.08 mass % or more, and is preferably 0.2 mass % or less, more preferably 0.17 mass % or less, and even more preferably 0.13 mass % or less.

<34> The method of producing a structure for producing a casting described in any of <2> to <33>, wherein the slurry composition obtained in the process (I) contains the inorganic particles, the content of the inorganic particles in the slurry composition is preferably 0.3 mass % or more, more preferably 0.6 mass % or more, and even more preferably 1.1 mass % or more, and is preferably 2.6 mass % or less, more preferably 2.3 mass % or less, and even more preferably 2.0 mass % or less, and the configuration of <2> or <3> is further included.

<35> The method of producing a structure for producing a casting described in any of <1> to <34>, wherein the slurry composition obtained in the process (I) contains a reinforcing agent for paper in a proportion of preferably 0.0003 mass % or more and more preferably 0.0006 mass % or more, and of preferably 0.007 mass % or less and more preferably 0.003 mass % or less.

<36> The method of producing a structure for producing a casting described in any of <1> to <35>, wherein the slurry composition obtained in the process (I) contains a coagulant in a proportion of preferably 0.0006 mass % or more, more preferably 0.001 mass % or more, and even more preferably 0.003 mass % or more, and of preferably 0.07 mass % or less, more preferably 0.05 mass % or less, and even more preferably 0.03 mass % or less.

<37> The method of producing a structure for producing a casting described in any of <1> to <36>, wherein the ratio of the major axis to the minor axis of the inorganic fiber, preferably the carbon fiber in the raw material slurry is preferably 1 or higher, more preferably 10 or higher, and even more preferably 50 or higher, and is preferably 5000 or lower, more preferably 2000 or lower, and even more preferably 1000 or lower.

<38> The method of producing a structure for producing a casting described in any of <1> to <34>, wherein, in the process (I-1), the mixture of the organic fiber, the thermosetting resin, and water is fed into a pulper, and 2000 kg of the mixture is disaggregated at a frequency of preferably 10 Hz or higher, more preferably 20 Hz or higher, and even more preferably 30 Hz or higher, and of preferably 200 Hz or lower, more preferably 150 Hz or lower, and even more preferably 100 Hz or lower, and an disaggregation time is preferably 1 minute or longer, more preferably 2 minutes or longer, and even more preferably 3 minutes or longer, and is preferably 30 minutes or shorter, more preferably 25 minutes or shorter, and even more preferably 20 minutes or shorter.

<39> The method of producing a structure for producing a casting described in any of <1> to <38>, wherein, in the process (I-1), the mixture of the organic fiber, the thermosetting resin, and water is beaten by using a beating means selected from a refiner, a beater, and a PFI mill, or preferably by using a refiner.

<40> The method of producing a structure for producing a casting described in <39>, wherein the beating means is the refiner, and beating is performed under conditions of a load value of preferably 5 kW or higher, more preferably 7 kW or higher, and even more preferably 10 kW or higher, and of preferably 50 kW or lower, more preferably 30 kW or lower, and even more preferably 20 kW or lower, a flow rate of preferably 10 L/min or higher, more preferably 20 L/min or higher, and even more preferably 30 L/min or higher, and of preferably 200 L/min or lower, more preferably 150 L/min or lower, and even more preferably 130 L/min or lower, and a beating time of preferably 5 minute or longer, more preferably 8 minutes or longer, and even more preferably 10 minutes or longer, and of preferably 90 minutes or shorter, more preferably 80 minutes or shorter, and even more preferably 70 minutes or shorter.

<41> A method of producing a casting by using the structure for producing a casting obtained in the producing method described in any of <1> to <40>.

<42> A structure for producing a casting obtained in the producing method described in any of <1> to <40>.

<43> A structure for producing a casting obtained from a slurry composition, the slurry composition containing an organic fiber, an inorganic fiber, a thermosetting resin, and water, wherein an average fiber length of the inorganic fiber in the structure for producing a casting is 1 mm or longer and 5 mm or shorter.

<44> A structure for producing a casting obtained from a slurry composition, the slurry composition containing an organic fiber, an inorganic fiber, inorganic particles, a thermosetting resin, and water, wherein an average fiber length of the inorganic fiber in the structure for producing a casting is 1 mm or longer and 5 mm or shorter.

<45> The structure for producing a casting described in any of <42> to <44>, wherein the organic fiber is one or more types selected from a paper fiber, a fibrillated synthetic fiber, and a regenerated fiber.

<46> The structure for producing a casting described in any of <42> to <45>, wherein the inorganic particles are preferably one or more types selected from obsidian, graphite, mica, silica, hollow ceramic, and fly ash, and the configuration of <2>, <3>, or <44> is included.

<47> The structure for producing a casting described in any of <42> to <46>, wherein an average particle diameter of the inorganic particles is preferably 10 μm or longer and more preferably 20 pin or longer, and is preferably 60 μm or shorter and more preferably 40 μm or shorter, and the configuration of <2>, <3>, or <44> is included.

<48> The structure for producing a casting described in any of <42> to <47>, wherein the thermosetting resin is preferably one or more types selected from a phenolic resin, an epoxy resin, and a furan resin, and is more preferably a phenolic resin.

<49> The structure for producing a casting described in any of <42> to <48>, further comprising a reinforcing agent for paper.

EXAMPLES

The following Examples describe the implementation of the invention. Examples describe examples of the invention and do not limit the invention.

Example 1

After subjecting a fiber laminate to papermaking by using the following raw material slurry, the fiber laminate was dehydrated and dried such that runners 4 to 8 (straight pipes 4 to 6 and elbow pipes 7 and 8) which are connected to ceramic tube 1 to 3 to be used as illustrated in FIG. 1 were obtained. In addition, the preparation of the raw material slurry and the composition of a structure were applied as shown in Table 1. The moisture content of the obtained structure was 2 mass % and the density thereof was 0.8 g/cm$^3$.

<Process (I)>

An organic fiber, a thermosetting resin, and water as a dispersion medium in the proportions shown in Process (I-1) of Table 1 were fed into a pulper and were disaggregated at 70 Hz for 5 minutes such that a mixture was obtained. After the disaggregation, the mixture was conveyed to a refiner and was subjected to a beating treatment at a circulation flow rate of 70 L/min to 80 L/min and a refiner load value of 15 kW for 50 minutes (process (I-1)). The mixture was conveyed to a 10 m$^3$ tank, and water in a proportion shown in Process (I-2) of Table 1 was fed and mixed (process (I-2)). The mixture was mixed with inorganic particles, a coagulant, a reinforcing agent for paper, and an inorganic fiber in the proportions shown in Process (I-3) of Table 1 and the resultant was subjected to a stirring operation such that an aqueous raw material slurry was prepared (process (I-3)). The total mass of the entire solid content in the raw material slurry was about 3 mass %. In addition, each of the components shown in Table 1 is as follows.

[Organic Fiber]

Organic fiber: waste newspaper (an average fiber length of 1 mm)

[Inorganic Fiber]

Inorganic fiber: carbon fiber (manufactured by Mitsubishi Rayon Co., Ltd., trade name "TCTR03164I", an average fiber length of 3 mm, an average fiber diameter of 7 μm (a ratio of major axis to minor axis of 429); sizing agent: water-soluble polyamide, an adhesion amount of 1%)

[Inorganic Particles]

Obsidian: (KINSEI MATEC Co., Ltd., "Nice Catch Flower #330", an average particle diameter of 30 μm)

[Thermosetting Resin]

Phenolic resin: (manufactured by Air Water Inc., trade name "Bellpearl S-890" (resol type))

[Coagulant]

Coagulant: polyamide epichlorohydrin (manufactured by Seiko PMC Corporation, trade name WS-4020, a solid content of 25 mass %)

[Reinforcing Agent for Paper]

Reinforcing agent for Paper: a 1 mass % aqueous solution of carboxymethyl cellulose

[Dispersion Medium]

Dispersion medium: water

<Process (II)>

As a papermaking mold, a metallic mold having a cavity formation surface corresponding to the above-described structure (the straight pipes and the elbow pipes) was used. On the cavity formation surface of the metallic mold, a net having a predetermined aperture is disposed, and a large number of communication holes which allow the cavity formation surface to communicate with the outside are formed. In addition, the metallic mold is constituted by a pair of split molds. The raw material slurry was circulated by a pump, a predetermined amount of the slurry was fed into the papermaking mold under pressure, and water in the slurry was removed through the communication holes such that a predetermined fiber laminate was deposited on the surface of the net. When the injection of the predetermined amount of the raw material slurry was completed, pressurized air was injected into the papermaking mold to dehydrate the fiber laminate. The pressure of the pressurized air was 0.2 MPa, and a time for the dehydrating was about 30 seconds.

<Process (III)>

As a drying mold, a metallic mold having a cavity formation surface corresponding to the above-described structure (the straight pipes and the elbow pipes) was used. In the metallic mold, a large number of communication holes which allow the cavity formation surface to communicate with the outside are formed. In addition, the metallic mold is constituted by a pair of split molds. The fiber laminate was taken out of the papermaking mold and was placed in the drying mold heated to 200° C. In addition, a bag-shaped elastic core was inserted from the upper opening of the drying mold, and into the corresponding elastic core in the sealed drying mold, pressurized air (0.2 MPa) was injected into the elastic core to inflate the elastic core such that the fiber laminate was pressed against the inner surface of the drying mold by the elastic core and was dried while the inner surface shape of the drying mold was transferred to the surface of the fiber laminate. After performing drying (for 60 seconds) under pressure, the pressurized air in the elastic core was extracted to allow the elastic core to shrink and be taken out of the drying mold. The molded body was extracted from the drying mold and was cooled, thereby obtaining the thermally cured structure.

<Evaluation of Lumps>

After molding the structure by using the raw material slurry, whether a lump was present in the structure was observed. When the incorporation of lumps was not confirmed, "absent" was written, and when the present of a lump was confirmed, "present" was written. The results are shown in Table 1. The absence of the incorporation of the lumps means good surface smoothness.

<Evaluation of Compressive Strength of Structure>

Figure 3:
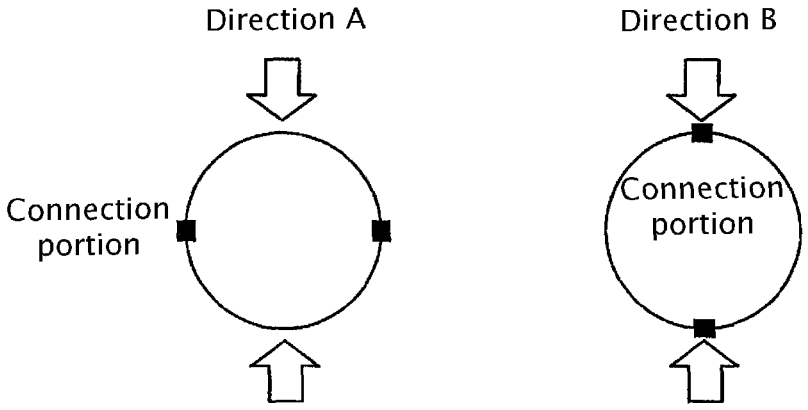
FIG. 3 is a schematic view illustrating directions in which compressive strength is measured in Examples and Comparative Examples.

The compressive strength of the straight pipe (an inner diameter of ϕ70 mm, a length of 310 mm) of the structure molded as described above was measured by using a digital force gauge "DPRSX-50T" (manufactured by IMADA Co., Ltd.). The measurement was performed by using a ϕ30 mm compressing tool at a lowering speed of 10 mm/min, and the maximum value was shown in Table 1. As illustrated in FIG. 3, strength measured at a position at 90° in a peripheral direction with respect to a connection portion of the straight pipe is referred to as "Direction A", and strength measured at the connection portion of the straight pipe is referred to as "Direction B" in the table.

<Evaluation of Thermal Contraction Amount>

The straight pipe (an inner diameter of ϕ70 mm, a length of 310 mm) of the structure molded as described above was cut into a length of 30 mm, the obtained sample and graphite were put in a crucible, and the crucible was covered and was baked in a furnace at 1000° C. for 1 hour. The inner diameter of the sample before and after the baking was measured at 5 points with a vernier caliper, and the measurement values were averaged to calculate the thermal contraction amount (%)={(the average of the inner diameter of the sample before the baking−the average of the inner diameter of the sample after the baking)/the average of the inner diameter of the sample before the baking}×100.

<Evaluation of Casting and Casting Quality (Length of Metal Penetration in Casting)>

Figure 2:
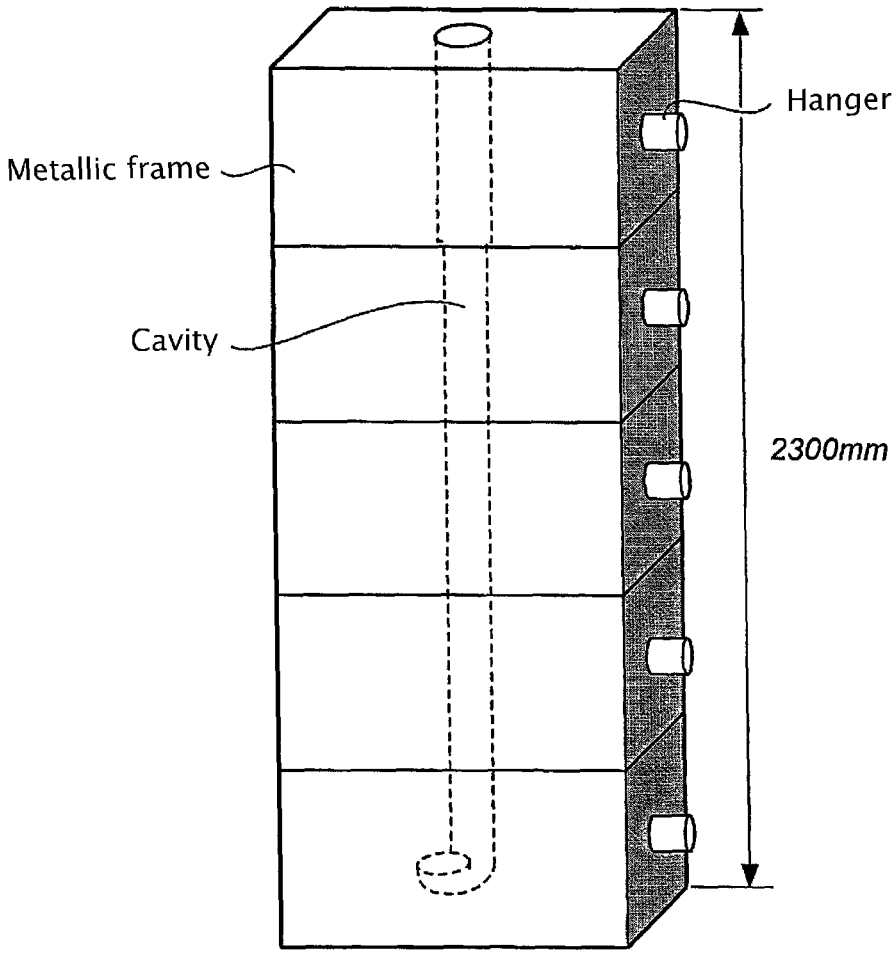
FIG. 2 is a schematic view illustrating a mold used in Examples and Comparative Examples.

The ceramic tube runners as the upper parts 1 to 3 and therebelow, the structures 4 to 8 obtained as described above were connected to form a cavity as illustrated in FIG. 1. Thereafter, the cavity was installed in the inside of metallic frames overlapped as illustrated in FIG. 2 and was filled with molding sand (furan regenerated sand) to shape a mold having a height of 2300 mm. In addition, in FIG. 2, the opening of the structure 8 was in a blocked state, and molten metal was allowed to fill the inside of the cavity.

Here, as the ceramic tube runners 1 to 3, the straight pipes (an inner diameter of ϕ70 mm, a length of 300 mm) of the ceramic tubes were used, as the structures 4 to 6, straight pipes (an inner diameter of ϕ70 mm, a length of 310 mm) were used, and as the structures 7 and 8, elbow pipes (an inner diameter of ϕ70 mm, a length of 322 mm) were used. The connection between the structures was performed by inserting, into a fitting portion formed at one end of the structure, the other end of the other structure. The ceramic tubes were connected by a packing tape, and the connection between the ceramic tube 3 and the structure 4 was performed by cutting the inner diameter of the ceramic tube 3 so as to allow the structure 4 to be inserted thereinto and inserting the structure 4 into the inner diameter of the ceramic tube 3.

In addition, sand used for shaping the mold was furan regenerated sand, and with respect to 100 parts by mass of regenerated sand, 0.7 part by mass of "KAO LIGHTNER BF-5302" manufactured by Kao-Quaker Co., Ltd. was used as a furan resin, and 0.28 part by mass of "US-3/C-21=40%/60%" manufactured by Kao-Quaker Co., Ltd. was used as a hardener. The casting mass was about 69 kg.

By using the mold shaped as described above, a casting was produced using FC250 as a casting material at a casting temperature of about 1400° C.

The lengths of the molten metal leaking at points where the structure was used in the casting after the casting was measured, and the lengths were added. The results are shown in Table 1.

Example 2

In Example 2, a structure for producing a casting was obtained in the same manner as in Example 1 except that the mass % of the inorganic fiber of the structure composition was 3 mass % and the mass % of the inorganic particles was 53 mass %. The moisture content of the obtained structure for producing a casting was 2 mass %, and the density thereof was 0.9 g/cm$^3$. The same evaluations as those of Example 1 were conducted on the obtained structure for producing a casting, and the results are shown in Table 1.

Example 3

From the raw material slurry obtained in the same composition and method as those of Example 1, runners 4 to 8 having different inner diameters were produced. That is, for the structure for producing a casting, straight pipes having an inner diameter of ϕ50 mm and a length of 310 mm were produced as the straight pipes 4 to 6, and elbow pipes having an inner diameter of ϕ50 mm and a length of 322 mm were produced as the elbow pipes 7 and 8. The moisture content of the obtained structure for producing a casting was 2 mass %, and the density thereof was 0.8 g/cm$^3$. The same evaluations as those of Example 1 were conducted on the obtained structure for producing a casting, and the results are shown in Table 1.

Example 4

In Example 1, by setting the mass % of the inorganic fiber of the structure composition to 2 mass % and setting the mass % of the inorganic particles to 54 mass %, runners 4 to 8 having different inner diameters were produced. That is, for the structure for producing a casting, straight pipes having an inner diameter of ϕ50 mm and a length of 310 mm were produced as the straight pipes 4 to 6, and elbow pipes having an inner diameter of ϕ50 mm and a length of 322 mm were produced as the elbow pipes 7 and 8. The moisture content of the obtained structure for producing a casting was 2 mass %, and the density thereof was 0.8 g/cm$^3$. The same evaluations as those of Example 1 were conducted on the obtained structure for producing a casting, and the results are shown in Table 1.

Comparative Example 1

A dispersion medium, an organic fiber, a thermosetting resin, and an inorganic fiber in the proportions shown in Process (I-1) of Table 1 were fed into a pulper and were disaggregated at 70 Hz for 10 minutes, and thereafter the raw material was conveyed to a refiner and was subjected to a beating treatment at a circulation flow rate of 70 L/min to 80 L/min and a refiner load value of 15 kW for 50 minutes. The slurry was conveyed to a 10 $m^3$ tank, and water in a proportion shown in Process (I-2) of Table 1 was fed and mixed. The mixture was mixed with inorganic particles, a coagulant, and a reinforcing agent for paper in the proportions shown in Process (I-3) of Table 1 and the resultant was subjected to a stirring operation such that an aqueous raw material slurry was prepared. The total mass of the entire solid content in the raw material slurry was about 3 mass %. A structure for producing a casting was obtained by performing the processes (II) and (III) in the same manner as in Example 1. The moisture content of the obtained structure for producing a casting was 2 mass %, and the density thereof was 0.9 g/$cm^3$. The same evaluations as those of Example 1 were conducted on the obtained structure for producing a casting, and the results are shown in Table 1.

Comparative Example 2

A dispersion medium, an organic fiber, and a thermosetting resin in the proportions shown in Process (I-1) of Table 1 were fed into a pulper and were disaggregated at 70 Hz for 10 minutes, and thereafter the raw material was conveyed to a refiner and was subjected to a beating treatment at a circulation flow rate of 70 L/min to 80 L/min and a refiner load value of 15 kW for 50 minutes. The mixture was conveyed to a 10 $m^3$ tank in which water and an inorganic fiber in the proportions shown in Process (I-2) of Table 1 were mixed and stirred in advance. Inorganic particles, a coagulant, and a reinforcing agent for paper in the proportions shown in Process (I-3) of Table 1 were mixed and the resultant was subjected to a stirring operation such that an aqueous raw material slurry was prepared. The total mass of the entire solid content in the raw material slurry was about 3 mass %. A structure for producing a casting was obtained by performing the processes (II) and (III) in the same manner as in Example 1. The moisture content of the obtained structure for producing a casting was 2 mass %, and the density thereof was 0.8 g/$cm^3$. The same evaluations as those of Example 1 were conducted on the obtained structure for producing a casting, and the results are shown in Table 1.

Comparative Example 3

Water, an organic fiber, a thermosetting resin, and an inorganic fiber in the proportions shown in Process (I-1) of Table 1 were fed into a pulper and were disaggregated at 70 Hz for 5 minutes, and thereafter the raw material was conveyed to a refiner and was subjected to a beating treatment at a circulation flow rate of 70 L/min to 80 L/min and a refiner load value of 15 kW for 50 minutes. The slurry was conveyed to a 10 $m^3$ tank, and water in a proportion shown in Process (I-2) of Table 1 was fed. The mixture was mixed with inorganic particles, a coagulant, and a reinforcing agent for paper in the proportions shown in Process (I-3) of Table 1 and the resultant was subjected to a stirring operation such that an aqueous raw material slurry was prepared. The total mass of the entire solid content in the raw material slurry was about 3 mass %. A structure for producing a casting was obtained by performing the processes (II) and (III) in the same manner as in Example 1 except that, for the runners 4 to 8 in the structure used to measure compressive strength and thermal contraction, the straight pipes 4 to 6 were changed to straight pipes having an inner diameter of ϕ50 mm and a length of 310 mm and the elbow pipes 7 and 8 were changed to elbow pipes having an inner diameter of ϕ50 mm and a length of 322 mm. The moisture content of the obtained structure for producing a casting was 2 mass %, and the density thereof was 0.8 g/$cm^3$. The same evaluations as those of Example 1 were conducted on the obtained structure for producing a casting, and the results are shown in Table 1.

Comparative Example 4

The same evaluations as those of Example 1 were conducted except that the inorganic fiber was changed to a carbon fiber having an average fiber length of 6 mm (manufactured by Mitsubishi Rayon Co., Ltd., trade name "TCTR06172F", an average fiber diameter of 7 μm, a ratio of major axis to minor axis of 857; sizing agent: water-soluble polyamide, an adhesion amount of 1%), the mass % thereof was changed to 2 mass %, the mass % of the inorganic particles was changed to 54 mass %, the straight pipes 4 to 6 for the runners 4 to 8 were changed to straight pipes having an inner diameter of ϕ50 mm and a length of 310 mm, and the elbow pipes 7 and 8 were changed to elbow pipes having an inner diameter of ϕ50 mm and a length of 322 mm. The results are shown in Table 1. The moisture content of the obtained structure for producing a casting was 2 mass %, and the density thereof was 0.9 g/$cm^3$.

TABLE 1

| | | Process (I) *1 | | | | | | | | | | |
|---|---|---|---|---|---|---|---|---|---|---|---|---|
| | | Process (I-1) | | | | Process (I-2) | | Process (I-3) | | | | Content of inorganic fiber with respect to water during mixing of inorganic fiber*3 (% by mass) |
| | | Organic fiber | Thermo-setting resin | Dispersion medium | Inor-gainic fiber | Inor-ganic fiber | Dispersion medium | Inor-ganic particle | coagulant | Paper strength rein-forcing agent | Inor-ganic fiber | |
| Example | 1 | Waste newspaper (26) | Phenol resin (18) | Water (820) | — | — | Water (2400) | Obsidian (52) | WS-4020 (2.5) | CMC 1 mass % aqueous solution (2.5) | Carbon fiber (4) | 0.12% |

TABLE 1-continued

| | | | | | | | | | | | | |
|---|---|---|---|---|---|---|---|---|---|---|---|---|
| | 2 | Waste newspaper (26) | Phenol resin (18) | Water (820) | — | — | Water (2400) | Obsidian (53) | WS-4020 (2.5) | CMC 1 mass % aqueous solution (2.5) | Carbon fiber (3) | 0.09% |
| | 3 | Waste newspaper (26) | Phenol resin (18) | Water (820) | — | — | Water (2400) | Obsidian (52) | WS-4020 (2.5) | (CMC 1 mass % aqueous solution (2.5) | Carbon fiber (4) | 0.12% |
| | 4 | Waste newspaper (26) | Phenol resin (18) | Water (820) | — | — | Water (2400) | Obsidian (54) | WS-4020 (2.5) | CMC 1 mass % aqueous solution (2.5) | Carbon fiber (2) | 0.06% |
| Comparative example | 1 | Waste newspaper (26) | Phenol resin (18) | Water (820) | Carbon fiber (8) | — | Water (2400) | Obsidian (48) | WS-4020 (2.5) | CMC 1 mass % aqueous solution (2.5) | — | 0.98% |
| | 2 | Waste newspaper (26) | Phenol resin (18) | Water (820) | — | | *2 Carbon fiber (4) + water (2667) | Obsidian (52) | WS-4020 (2.5) | CMC 1 mass % aqueous solution (2.5) | — | 0.15% |
| | 3 | Waste newspaper (26) | Phenol resin (18) | Water (820) | Carbon fiber (8) | — | Water (2400) | Obsidian (48) | WS-4020 (2.5) | CMC 1 mass % aqueous solution (2.5) | — | 0.90% |
| | 4 | Waste newspaper (26) | Phenol resin (18) | Water (820) | — | — | Water (2400) | Obsidian (54) | WS-4020 (2.5) | CMC 1 mass % aqueous solution (2.5) | Carbon fiber (2) | 0.06% |

| | | Structure for producing casting Composition *4 | | | | | | | | | |
|---|---|---|---|---|---|---|---|---|---|---|---|
| | | | | Inorganic fiber | | | | | | | |
| | | | | | | Average fiber lenght (mm) | | | | | |
| | | Organic fiber | | | | During | | Inorganic particle | | Thermosetting resin | |
| | | Type | parts by mass | Type | parts by mass | slurry mixing | In structure | Type | parts by mass | Type | parts by mass |
| Example | 1 | Waste newspaper | 26 | Carbon fiber | 4 | 3 | 3 | Obsidian | 52 | Phenol resin | 18 |
| | 2 | Waste newspaper | 26 | Carbon fiber | 3 | 3 | 3 | Obsidian | 53 | Phenol resin | 18 |
| | 3 | Waste newspaper | 26 | Carbon fiber | 4 | 3 | 3 | Obsidian | 52 | Phenol resin | 18 |
| | 4 | Waste newspaper | 26 | Carbon fiber | 2 | 3 | 3 | Obsidian | 54 | Phenol resin | 18 |
| Comparative example | 1 | Waste newspaper | 26 | Carbon fiber | 8 | 3 | 0.21 | Obsidian | 45 | Phenol resin | 18 |
| | 2 | Waste newspaper | 26 | Carbon fiber | 4 | 3 | 3 | Obsidian | 52 | Phenol resin | 18 |
| | 3 | Waste newspaper | 26 | Carbon fiber | 8 | 3 | 0.21 | Obsidian | 45 | Phenol resin | 18 |
| | 4 | Waste newspaper | 26 | Carbon fiber | 2 | 6 | 6 | Obsidian | 54 | Phenol resin | 18 |

| | | Results of evaluation | | | | |
|---|---|---|---|---|---|---|
| | | | Compressive strenght of structure (N) | | Thermal contraction | Length of metal penetration in casing |
| | | Lumps | Direction A | Direction B | amount (%) | (min) |
| Example | 1 | Absent | 130 | 119 | 0.4 | 0 |
| | 2 | Absent | 110 | 122 | 0.8 | 0 |
| | 3 | Absent | 233 | 236 | 0.4 | 0 |
| | 4 | Absent | 142 | 148 | 1.2 | 870 |

TABLE 1-continued

| | | | | | | |
|---|---|---|---|---|---|---|
| Comparative example | 1 | Absent | 106 | 93 | 1.3 | 1760 |
| | 2 | Present | 131 | 130 | 0.4 | 0 |
| | 3 | Absent | 162 | 159 | 2.3 | 2750 |
| | 4 | Absent | 174 | 97 | 0.7 | 1430 |

*1 Numbers in ( ) represent parts by mass of each component when the sum of the organic fiber, the thermosetting resin, the inorganic particles, and the inorganic fiber was 100 parts by mass.
*2 Water and the carbon fiber were mixed and stirred in a tank in advance, and the mixture of the process (1-1) was fed thereinto.
*3 The mass's of the inorganic fiber with respect to the amount of water with which the inorganic fiber is initially mixed in the process (I) is shown.
*4 The parts by mass of each component with respect to 100 parts by mass of the structure for producing a casting are shown.

In Examples 1 to 4, the incorporation of lumps is not confirmed and the surface smoothness is excellent. In addition, regarding the compressive strength of the structure for producing a casting, the compressive strength is excellent in each of a case where strength measured at a position at 90° in a peripheral direction with respect to the connection portion of the straight pipe is referred to as "Direction A" and a case where strength measured at the connection portion of the straight pipe is referred to as "Direction B", and the difference therebetween is not large and is satisfactory. In addition, in Examples 1 to 4, the thermal contraction amount of the structure for producing a casting is small, the length of metal penetration in the obtained casting is small, and the resistance of metal penetration in the obtained casting is excellent. Particularly, in Examples 1 to 3, metal penetration of the obtained casting is not recognized and the casting is excellent.

In Comparative Examples 1 and 3, since the inorganic fiber is present in the process (I-1), the average fiber length in the structure is shortened due to beating. Therefore, the thermal contraction amount is large, and the length of metal penetration in casting is large, and thus the resistance of metal penetration in the obtained casting is deteriorated. In Comparative Example 2, the mixture obtained in the process (I-1) is mixed with the mixture in which the inorganic fiber is dispersed in water in advance in the process (I-2). In Comparative Example 2, when the amount of water in the process (I-2) is 2400 parts by mass as same as that in Example 1, the inorganic fiber (carbon fiber) is not easily dispersed, and thus the amount of water is increased. However, the ratio of the inorganic fiber to water with which the inorganic fiber is initially mixed in the process (I-2) is higher than that of Example 1 and the like. In Comparative Example 2, when the dispersibility of the inorganic fiber is increased by further increasing the amount of water, the amount of water in the raw material slurry is significantly increased due to the addition of water used in the process (I-1), and problems such as a reduction in drying efficiency occur. In the example of the addition as in Comparative Example 2, in practice, the ratio of the inorganic fiber to water with which the inorganic fiber is initially mixed in the process (I-2) is required to be set to be higher than that of Example 1 and the like, and thus lumps are generated, resulting in the degradation of surface smoothness. In Comparative Example 2, the content of the inorganic fiber in the raw material slurry that is finally obtained is 0.11 mass % and is close to that in Example 1 (0.12 mass %). In Comparative Example 4, despite the fact that the inorganic fiber is added in the process (I-3) as in Example 4, the average fiber length of the added inorganic fiber is long. Therefore, the strength in a direction of the connection portion of the structure for producing a casting is lower than the strength in a direction at 90° in the peripheral direction with respect to the direction of the connection portion of the structure for producing a casting. As a result, the length of metal penetration in the casting is increased, and thus the resistance of metal penetration in the obtained casting is deteriorated.

The invention claimed is:

1. A method of producing a structure for producing a casting, the method comprising:

a process (I) of obtaining a slurry composition containing an organic fiber, an inorganic fiber, a thermosetting resin, and water;

a process (II) of obtaining a fiber laminate by subjecting the slurry composition to papermaking; and a process (III) of dehydrating the fiber laminate and thereafter drying the resultant, wherein the process (I) includes:

a process (I-1) of beating a mixture containing the organic fiber and water, a process (I-2) of mixing the mixture obtained in the process (I-1) and water, and a process (I-3) of mixing the mixture obtained in the process (I-2) and the inorganic fiber, the thermosetting resin is mixed in at least any of the process (I-1), the process (I-2), and the process (I-3), and an average fiber length of the inorganic fiber in the structure for producing a casting is 1 mm or longer and 5 mm or shorter.

2. The method of producing a structure for producing a casting according to claim 1, wherein a content of the inorganic fiber in the structure for producing a casting is 1 part by mass or more and 6 parts by mass or less with respect to 100 parts by mass of the structure for producing a casting.

3. The method of producing a structure for producing a casting according to claim 1, wherein, in the process (I), the inorganic fiber is used in a proportion of 0.14 mass % or less with respect to an amount of the water with which the inorganic fiber is initially mixed.

4. The method of producing a structure for producing a casting according to claim 1, wherein the average fiber length of the inorganic fiber used in the process (I) is 1 mm or longer and 5 mm or shorter.

5. The method of producing a structure for producing a casting according to claim 1, wherein the inorganic fiber is a carbon fiber.

6. A method of producing a casting, which uses the structure for producing a casting obtained in the producing method according to claim 1.

7. The method of producing a structure for producing a casting according to claim 1, wherein a ratio of a major axis to a minor axis of the inorganic fiber in the structure for producing a casting is 1 or higher, and is 5000 or lower.

8. The method of producing a structure for producing a casting according to claim 1, wherein a mass ratio of the organic fiber to the inorganic fiber in the structure for producing a casting is, in terms of inorganic fiber/organic fiber, 0.05 or higher, and is 1.0 or lower.

9. The method of producing a structure for producing a casting according to claim 1, wherein the content of the inorganic fiber in the slurry composition obtained in the process (I) is 0.03 mass % or more, and is 0.2 mass % or less.

10. The method of producing a structure for producing a casting according to claim 1, wherein the ratio of the major axis to the minor axis of the inorganic fiber in the raw material slurry is 1 or higher, and is 5000 or lower.

11. The method of producing a structure for producing a casting according to claim 1, wherein a content of the inorganic fiber in the slurry composition obtained in the process (I) is, with respect to 100 parts by mass of the sum of the organic fiber, the inorganic fiber, the inorganic particles, and the thermosetting resin used in the entire process (I), 1 part by mass or more, and is 6 parts by mass or less.

12. A method of producing a structure for producing a casting, the method comprising:

a process (I) of obtaining a slurry composition containing an organic fiber, an inorganic fiber, inorganic particles, a thermosetting resin, and water;

a process (II) of obtaining a fiber laminate by subjecting the slurry composition to papermaking; and a process (III) of dehydrating the fiber laminate and thereafter drying the resultant, wherein the process (I) includes:

a process (I-1) of beating a mixture containing the organic fiber and water, a process (I-2) of mixing the mixture obtained in the process (I-1) and water, and a process (I-3) of mixing the mixture obtained in the process (I-2) and the inorganic fiber, the thermosetting resin is mixed in at least any of the process (I-1), the process (I-2), and the process (I-3), the inorganic particles are mixed in at least any of the process (I-1), the process (I-2), and the process (I-3), and an average fiber length of the inorganic fiber in the structure for producing a casting is 1 mm or longer and 5 mm or shorter.

13. A method of producing a structure for producing a casting according to claim 12, the method including:

a process (I) of obtaining a slurry composition containing the organic fiber, the inorganic fiber, the inorganic particles, the thermosetting resin, and water;

a process (II) of obtaining the fiber laminate by subjecting the slurry composition to papermaking; and a process (III) of dehydrating the fiber laminate and thereafter drying the resultant, wherein the process (I) includes:

a process (I-1) of beating a mixture containing the organic fiber, the thermosetting resin, and water, a process (I-2) of mixing the mixture obtained in the process (I-1) and water, and a process (I-3) of mixing the mixture obtained in the process (I-2), the inorganic fiber, and the inorganic particles, the average fiber length of the inorganic fiber in the structure for producing a casting is 1 mm or longer and 5 mm or shorter.

* * * * *